US007895694B2

(12) United States Patent
Fellinger

(10) Patent No.: US 7,895,694 B2
(45) Date of Patent: Mar. 1, 2011

(54) EXTENDABLE ROTARY SCRUBBER

(75) Inventor: Thomas J. Fellinger, Littleton, CO (US)

(73) Assignee: Johns Manville, Denver, CO (US)

( * ) Notice: Subject to any disclaimer, the term of this patent is extended or adjusted under 35 U.S.C. 154(b) by 1181 days.

(21) Appl. No.: 11/528,273

(22) Filed: Sep. 27, 2006

(65) Prior Publication Data

US 2008/0072385 A1 Mar. 27, 2008

(51) Int. Cl.
*A46B 13/00* (2006.01)

(52) U.S. Cl. ..... 15/23; 15/21.1; 15/52.1; 15/3; 15/93.4; 15/98

(58) Field of Classification Search ..... 15/21.1, 15/23, 93.4, 98, 144.1–144.4; 29/33; 16/426, 16/429; 451/354, 358
See application file for complete search history.

(56) References Cited

U.S. PATENT DOCUMENTS

| | | | | |
|---|---|---|---|---|
| 1,919,854 | A * | 7/1933 | Masseau | 15/50.3 |
| 2,190,576 | A * | 2/1940 | Sisman | 15/50.3 |
| 2,238,757 | A * | 4/1941 | Stevason | 15/98 |
| 3,138,814 | A * | 6/1964 | Carrona | 15/98 |
| 3,967,339 | A | 7/1976 | Newman | |
| 4,191,792 | A | 3/1980 | Janssen | |
| 4,404,703 | A | 9/1983 | Woodall, Jr. et al. | |
| 4,677,815 | A | 7/1987 | Stahlecker | |
| 4,734,729 | A | 3/1988 | Hertzel et al. | |
| 5,167,719 | A | 12/1992 | Tamaki | |
| 5,401,231 | A | 3/1995 | Hebert | |
| 5,403,128 | A | 4/1995 | Thomas | |

(Continued)

OTHER PUBLICATIONS

IDI Distributors Inc, "Stud Scrubber," Online Brochure, http://idimn.com/pages.spray_insulation.html, Mar. 2006.

(Continued)

*Primary Examiner*—Monica S Carter
*Assistant Examiner*—Stephanie Newton
(74) *Attorney, Agent, or Firm*—Robert D. Touslee

(57) ABSTRACT

This relates generally to devices used in the removal of excess spray-applied insulation from building components, and more particularly to an improved rotary scrubber that is readily extendable for reaching areas of extended elevation. To facilitate the scrubbing of insulation from areas of extended elevation, one embodiment of the scrubber has an adjustable handle assembly connected to the housing. The adjustable handle assembly preferably comprises a receiver connected to the housing and an extension and a support handle adjustably connected with the receiver. The extension preferably defines an extension handle, with the support handle adjustably connected with the receiver forward of the extension handle when the extension is adjustably connected with the receiver. In other embodiments, the scrubber further comprises at least one extender optionally removably connectable between the scrubber's housing and the framework. The at least one extender comprises a ferrule member, connecting the housing to the gearbox of the framework and enclosing an extender drive link operably associating the motor and gearbox. The at least one extender, may comprise any number of extenders, from one extender to a plurality of extenders. If desired, a plurality of extenders may be utilized in end-to-end relation, with each extender adapted for a removable connection between the housing and the framework, between another extender and the framework, between another extender and the housing or between other extenders of the plurality.

27 Claims, 19 Drawing Sheets

U.S. PATENT DOCUMENTS

| | | | | |
|---|---|---|---|---|
| 5,567,197 | A * | 10/1996 | Evensen | 451/358 |
| 5,713,095 | A | 2/1998 | Wakat | |
| 5,921,854 | A * | 7/1999 | Evensen | 451/504 |
| 6,280,371 | B1 | 8/2001 | Krippelz | |
| 6,875,162 | B2 | 4/2005 | Barksdale et al. | |
| 6,918,864 | B1 | 7/2005 | Brown et al. | |
| 7,156,728 | B1 * | 1/2007 | Killough | 451/361 |
| 2003/0051315 | A1 * | 3/2003 | Lau | 16/426 |
| 2003/0074765 | A1 * | 4/2003 | Quimby | 16/426 |
| 2006/0118038 | A1 | 6/2006 | Bowman et al. | |
| 2008/0040892 | A1 * | 2/2008 | Jenkins | 16/426 |

OTHER PUBLICATIONS

ADO Products, "Stud Scrubbers," Online Brochure, Http://www.adodistribution.com, Mar. 2006.

Krendel Fiber Moving Equipment, "Wall Scrubber," Online Brochure, http://krendlmachine.com/products.wallcavitysystems.asp, Mar. 2006.

Johns Manville, Spider Video, Online Video, http://www.jm-builder.com/spider.php, Date unknown.

Spider Equipment Reference, Johns Manville Spider Equipment Manual, p. 4-9, Date unknown.

Spider Usage, Johns Manville Spider Equipment Manual, pp. 7-10 and 7-12, Date unknown.

* cited by examiner

EXTENDABLE ROTARY SCRUBBER

CROSS REFERENCE TO RELATED APPLICATIONS

This application is related to co-pending U.S. patent application Ser. Nos. 11/528,272, 11/528,271 and 29/272,571, each filed on Sep. 27, 2006, each of which are incorporated by reference herein.

TECHNICAL FIELD

This relates generally to devices used in the removal of excess spray-applied insulation from building components, and more particularly to an improved rotary scrubber that is readily extendable for reaching areas of extended elevation.

BACKGROUND

Sprayed insulation is commonly used in the construction industry for insulating the open cavities of building walls, floors, ceilings, attics and other areas. Insulation materials, such as loose fiberglass, rock wool, mineral wool, fibrous plastic, cellulose, ceramic fiber, etc., that is combined with an adhesive or water, are sprayed from an applicator into such open cavities to reduce the rate of heat loss or gain therethough. The adhesive properties of the insulation mixture, resulting from the combination of the insulation materials with the adhesive or water, allow it to adhere to vertical or overhanging surfaces, thus allowing for an application of insulation prior to the installation of wallboard and similar cavity enclosing materials.

In applying sprayed insulation into open cavities, an installer typically holds an outlet end of the applicator towards the open cavity and then sprays the insulation and adhesive mixture into the cavity until the cavity is filled. To ensure that the cavity is completely filled, an installer typically sprays an excess amount of the mixture into the cavity such that an excess quantity (i.e. overfill) of the sprayed insulation has accumulated beyond an opening of the cavity defined by the cavity's confining boundaries, i.e. beyond the wall studs, floor or ceiling joists or other framing members defining the cavity. Such an excess amount or overfill is often necessary to ensure a complete fill of the cavity with the insulation mixture, thus minimizing the presence of gaps or voids therein and ensuring that the claimed thermal or acoustic performance, as specified by the manufacturer of the insulation product, is met.

However, to allow for the installation of wallboard, a vapor retarder or other surface materials over the cavity after receiving the insulation mixture, the excess or overfill insulation must be compacted into the cavity or removed therefrom to allow the surface materials to lay flush against the framing members. Excess insulation mixture located on the faces or outer surfaces of the framing members must be removed as well. The excess or overfill sprayed insulation mixture is thus removed or "scrubbed" from the cavity and faces of the framing members with a rotary scrubber to define an outer surface or boundary of the mixture at the cavity's opening lying preferably co-planar with the faces of the framing members.

The rotary scrubber generally comprises a hand-held device having a rotating, motor-driven roller assembly attached thereto. The roller assembly, typically located at a forward end of a framework of the device and including at least one cylindrical brush or textured roller, is driven to rotate by a motor and associated drive belt, also located on the device. The drive belt is in contact with the roller assembly via a pulley or channel defined in the outer surface of the brush or roller. The rotating roller assembly preferably has an end-to-end length that spans or exceeds the width of a building cavity as defined by the framing members. Thus, during the removal process, the rotating roller assembly is positioned against the faces of the framing members to span the width of the cavity. The rotating roller assembly is then pulled along the framing members, preferably in a direction about parallel thereto, such that the brush or roller of the assembly contacts and scrubs the excess of overfill insulation mixture from the cavity and framing members, thus creating the outer surface or boundary of the insulation that is preferably co-planar with the framing members.

Although various rotary scrubbers are presently available to facilitate the removal of excess or overfill sprayed insulation mixtures from building cavities, numerous disadvantages exist with these scrubbers. For example, presently-available scrubbers are not readily adaptable for the removal of insulation mixture from building cavities of extended elevation, thus limiting the vertical reach of these devices. The removal of insulation mixture from areas of extended elevation using such presently-available scrubbers thus often requires the cumbersome use of ladders, step-stools or scaffolding. Although some presently-available scrubbers allow for an extension of vertical reach, the framework of such devices must be fitted or substituted with an "extension" that increases the length of the framework (i.e. arms) that support the devices' roller assembly. However, because increasing the length of the framework supporting the roller assembly of these devices also typically increases the distance between the belt-driven roller assembly and the drive motor, a longer drive belt must also be utilized with these devices along with the extension.

Fitting an extension and associated drive belt to a presently-available scrubber thus requires a disassembly and re-assembly of the device and necessitates the requisite additional extension and belt components. The disassembly and re-assembly of a scrubber to accommodate an extension and associated drive belt thus increases the nonproductive "down-time" of an insulation installation project, while the need for additional belts results in the need to purchase and maintain additional equipment components. Both result in an undesirable increase in project cost.

Disadvantages are also inherently associated with the design and structure of presently-available rotary scrubbers. Presently-available scrubbers typically utilize either a singular or a "U-shaped" framework in association with a singular drive belt to support and drive the rotating roller assembly. The singular framework, typically having the roller assembly located at a forward end of a single extending member, has the drive belt located about the member and over the forward portion of the member at the roller assembly. The "U-shaped" framework, typically having the roller assembly located at the forward ends of twin extending members of the U-shaped frame, typically has the belt located between the twin extending members of the frame.

The singular framework is subject to undesirable bending due to torsion forces applied through the ends of the roller assembly when pulled along the faces or outer surfaces of building cavity framing members during scrubbing procedures. The singular framework is also subject to bending or other damage if the rotary scrubber is inadvertently dropped. Although the "U-shaped" framework may overcome the bending deficiencies of the singular framework, its use in association with a singular drive belt results in a "gouging" of insulation material from the building cavity. Because each twin extending member of the U-shaped frame, where connected to the rotating roller assembly, does not have the belt located about the member and over the forward portion thereof at the brush or roller, the non-moving forward portion of each member drags against the insulation during scrubbing procedures, thus resulting in the occurrence of such undesirable gouging.

Furthermore, the singular drive belt, in transmitting rotational energy from the drive motor to the rotating roller assembly, must overcome the resistance forces created through a contact of the roller assembly with both the faces of the building cavity framing members and the excess or overfill insulation scrubbed from the cavity itself. Such resistance forces are transmitted through the roller assembly to the drive belt via the contact between belt and the pulley or channel of the cylindrical brush or roller of the assembly. Because only a singular belt is in contact the cylindrical brush or roller of the roller assembly, the contact between the belt and assembly is often insufficient to overcome the resistance forces acting on the assembly, thus resulting in belt-slip and an undesirable "stalling" of the rotating roller assembly.

Thus, what is needed is a rotary scrubber that has a readily-adjustable vertical reach for accommodating the scrubbing of insulation from building cavities of extended elevation, without requiring either a disassembly of the scrubber's framework supporting the roller assembly or the need for additional belt components. The scrubber should have a framework and associated belt drive system that overcomes both the rigidity disadvantages of single-member frames and the gouging disadvantages of multi-member frames. The belt drive system of the scrubber should also readily overcome any resistance forces occurring between the belt drive and roller assembly to avoid belt slip and a stalling of the rotating roller assembly itself. This fulfills these foregoing needs.

SUMMARY

This relates generally to devices used in the removal of excess spray-applied insulation from building components, and more particularly to an improved rotary scrubber that is readily extendable for reaching areas of extended elevation. The extendable scrubber comprises a housing having forward and rearward ends and a framework having first and second ends, with the second end of the framework defining at least a forward end of at least one arm. In one embodiment, the first end of the framework is connected to the housing, with the connection of the framework to the housing preferably comprising a removable connection. The scrubber further comprises a roller assembly, comprised of at least one roller, rotatably associated with the at least a forward end of the at least one arm, with a motor connected to the housing and operably associated with at least one drive belt. Each at least one drive belt is operably associated with the roller assembly.

To extend the reach of the respective scrubbers, in one embodiment they further comprise an adjustable handle assembly connected to the housing while in another embodiment they further comprise at least one extender optionally removably connectable between the housing and the framework, with the at least one extender operably associating the at least one drive belt with the motor when connected therebetween. In additional embodiments, each drive belt of the at least one drive belt is preferably entrained around the at least a forward end of each arm to prevent a gouging of the excess insulation during scrubbing procedures. However, it is understood that each at least one drive belt may be located on the respective scrubber and not entrained around the at least a forward end of each arm as well.

In one embodiment of the extendable scrubber, the housing comprises a lower portion and an upper portion defining an enclosure, with the upper portion preferably defining a cover that is preferably removable from the lower portion to allow access to the enclosure. The first end of the framework is preferably connected to the forward end of the housing. In alternate embodiments, the housing preferably comprises a ferrule member defined by the housing's forward and rearward ends and an inner cylindrical surface, with the first end of the framework preferably comprising a gearbox connected thereto and adapted for removable connection with either the housing or optionally the at least one extender.

In one embodiment, the framework defines at least forward and rearward ends of the arm or arms of the extendable scrubber. In other embodiments, the framework defines a gearbox, a brace connected to the gearbox, at least one bracket adjustably connected to the brace, and at least forward end rearward arm ends, with the rearward end of the arm or arms connected to the at least one bracket. The connection between the gearbox and the remaining framework is adjustable to facilitate the adjustment of the tension of the at least one drive belt. In yet another embodiment, the at least one bracket and brace of the framework may be unitary to define a unitary portion at the framework's first end for connection with housing via the framework's gearbox. The framework having the gearbox further comprises a receiver, defined thereon to facilitate the connection of the housing and/or at least one extender to the framework.

Each at least a forward end of the arm or arms of the at least one arm defines a through, roller assembly bore that accommodates a roller assembly shaft to define the rotatable association of the roller assembly with the forward end of the at least one arm. For embodiments of the extendable scrubber having a framework defining the at least forward ends of a pair of arms of the at least one arm, the roller assembly, rotatably associated with the at least forward ends of the arms, preferably comprises a central roller and two outer rollers of the at least one roller. The central roller is located between the at least forward ends of the arms while the at least two outer rollers are axially aligned with the central roller and located outwardly of the arm ends. For embodiments of the extendable scrubber having a framework defining the at least a forward end of only a single arm of the at least one arm, the central roller is not utilized while first and second rollers of the at least one roller are axially aligned and located adjacent to opposite sides of the arm end.

In one embodiment, each at least one roller of the roller assembly rotates about the shaft connected to the at least forward ends of the arm or arms of the at least one arm via thrust bearing and race assemblies located between the shaft and each roller. In another embodiment, each at least one roller of the assembly is affixed to the shaft, with the shaft rotatably connected to the arm or arms of the scrubber via one or more press-fit bearing and race assemblies located therebetween.

To accommodate the operable relation between the roller assembly and the scrubber's drive belt or belt, in one embodiment, the outer surface of each roller defines a circumferal inlet that together define a groove or grooves in the roller assembly for operable engagement with the drive belt or belts. Alternatively, roller supports located at roller ends adjacent to the arm or arms of the scrubber each define a pulley surface that together define a pulley or pulleys in the roller assembly for operable engagement with the drive belt or belts.

The roller assembly is comprised of durable materials. In one embodiment, each at least one roller of the roller assembly is comprised of a polyurethane material having a durometer hardness range of between about 60 A and about 85 D, preferably about 75 D. It is understood, however, that polyurethane rollers of other durometer hardness may be utilized, as well as rollers comprised of other materials (i.e., aluminum, plastic, rubber, etc). Each at least one roller of the roller assembly preferably has a plurality of ribs defined in its outer surface. The ribs may be machined or cut into the outer surface of each roller, or the ribs may be formed by a molding or extrusion process. Each rib may have a triangular cross-section, a cross-section defining at least two right angles, or a cross-section defining a blade.

The motor, preferably connected to the housing, is operably associated with the drive belt or belts of the at least one drive belt, with such operable association preferably comprising at least one drive pulley or drive pulleys, respectively, engaging the belts and driven by the motor, or driven by the gearbox operably associated with the motor. In one embodiment, the motor drives the drive pulleys with a double-ended output shaft having a pulley connected at each end. With this configuration, the motor is preferably connected to the lower portion of the housing, with the output shaft oriented transverse to the at least forward ends of the arm or arms of the framework. In another embodiment, the drive pulleys are driven by a gearbox connected to the housing and operably associated with the motor. With this configuration, the motor is preferably connected to the lower portion of the housing, with the motor's output shaft driving the gearbox also connected to the lower portion of the housing. The gearbox output shaft has the drive pulleys connected at its respective ends.

In yet another embodiment, the motor is preferably connected at the rearward end of the housing with the gearbox of the framework removably connected at the forward end of the housing. The gearbox output shaft again has drive pulleys connected at its respective ends. The housing operably associates the gearbox with the motor wherein the housing preferably comprises a ferrule member enclosing a housing drive link. The output shaft of the motor preferably drives the gearbox via the housing drive link enclosed by the ferrule member of the housing, with the rearward end of the link connected to the output shaft of the motor and the forward end of the link removably connected to an input shaft of the gearbox. To facilitate the removable connection of the forward end of the housing to the gearbox of the framework, the receiver of the gearbox, defined at the rearward end thereof, is adapted to accept a removable insertion of the forward end of the housing ferrule member therein. Thus, the removable connection of both the forward end of the housing drive link to the input shaft of the gearbox and the forward end of the housing to the gearbox itself facilitates a removal of the framework from the housing to allow for the optional utilization of the at least one extender between the housing and framework. However, it is understood that further embodiments of the scrubber of may have a connection between the housing and framework that does not facilitate their removal from one another as well.

To facilitate the scrubbing of insulation from areas of extended elevation, one embodiment of the scrubber comprises an adjustable handle assembly connected to the housing. The adjustable handle assembly preferably comprises a receiver connected to the housing and an extension and a support handle adjustably connected with the receiver. The extension preferably defines an extension handle, with the support handle adjustably connected with the receiver forward of the extension handle when the extension is adjustably connected with the receiver. The adjustable connection of the extension with the receiver preferably comprises a mating engagement of at least a forward end of the extension with the receiver, and an extension fixator for releasably connecting the extension along the receiver. The adjustable connection of the support handle with the receiver preferably comprises a support handle fixator for releasably connecting the support handle along the receiver. In other embodiments, the extension fixator and the support handle fixator comprise a common fixator.

To facilitate the scrubbing of insulation from areas of extended elevation, other embodiments of the scrubber comprise at least one extender optionally removably connectable between the housing and the framework, with the at least one extender operably associating the at least one drive belt with the motor when connected there-between. The at least one extender comprises an extender ferrule member enclosing an extender drive link, with the extender ferrule member and drive link defining forward and rearward ends. To facilitate the removable connection of at least the forward end of the at least one extender to the gearbox of the framework, the forward end of the extender ferrule member is adapted for removable insertion into at least the receiver of the gearbox.

The forward end of the extender drive link is adapted for removable connection with the gearbox input shaft. The forward end of the housing is thus removably connectable with either the gearbox or the rearward end of the at least one extender while the forward end of the housing drive link is thus removably connectable with either the gearbox input shaft or the rearward end of the extender drive link. The forward ends of the at least one extender and extender drive link, in turn, are thus respectively removably connectable with at least the gearbox and gearbox input shaft, and optionally another with extender and extender drive link. The at least one extender, may comprise any number of extenders, from one extender to a plurality of extenders. If desired, a plurality of extenders may be utilized in end-to-end relation, with each extender adapted for a removable connection between the housing and the framework, between another extender and the framework, between another extender and the housing or between other extenders of the plurality.

DESCRIPTION OF THE EMBODIMENTS

Figure 1:
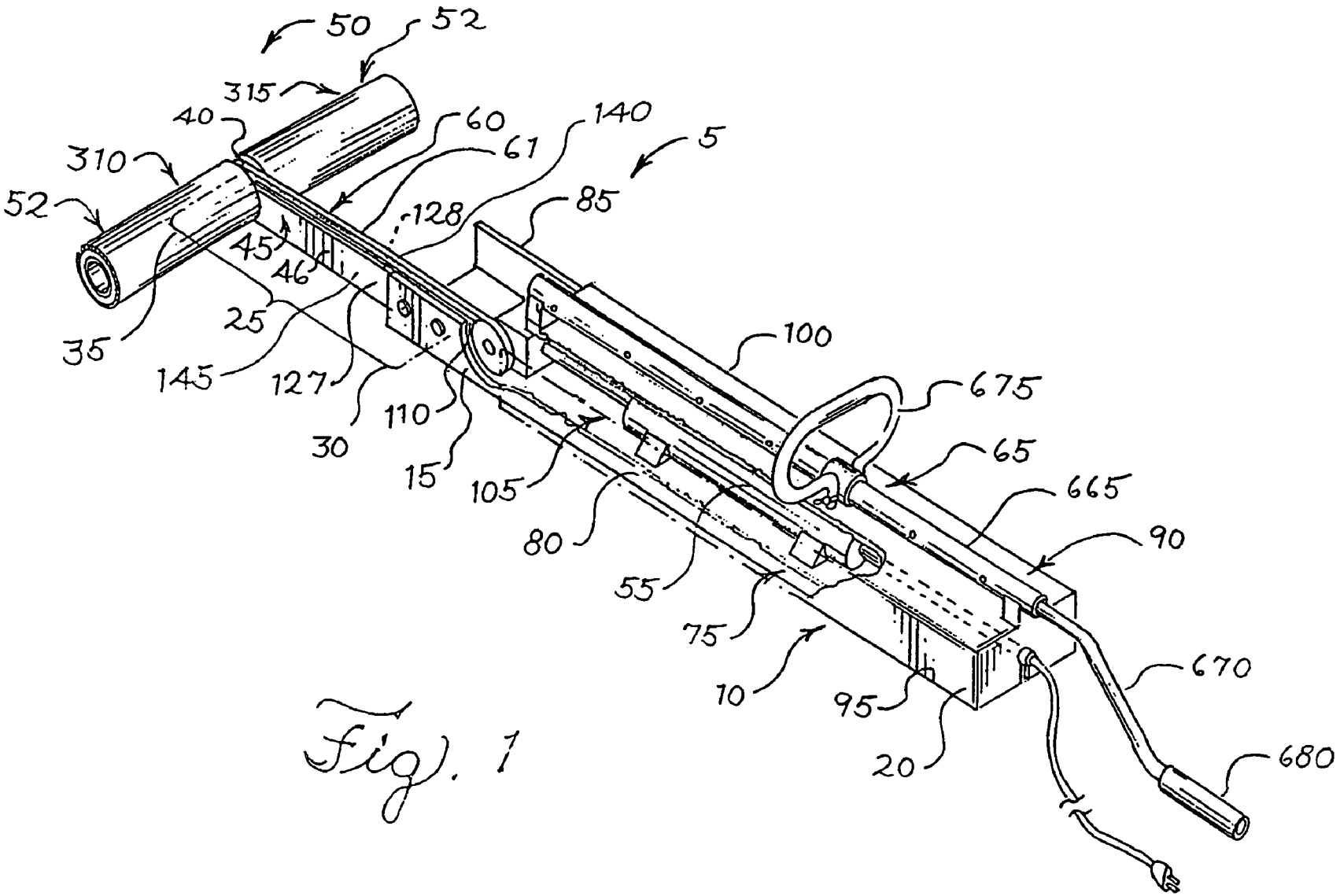
FIG. 1 is a perspective view of one embodiment of the extendable scrubber having a framework defining the at least forward and rearward ends of at least a one arm, with a portion of the housing removed to better illustrate the motor and related components.
Figure 2:
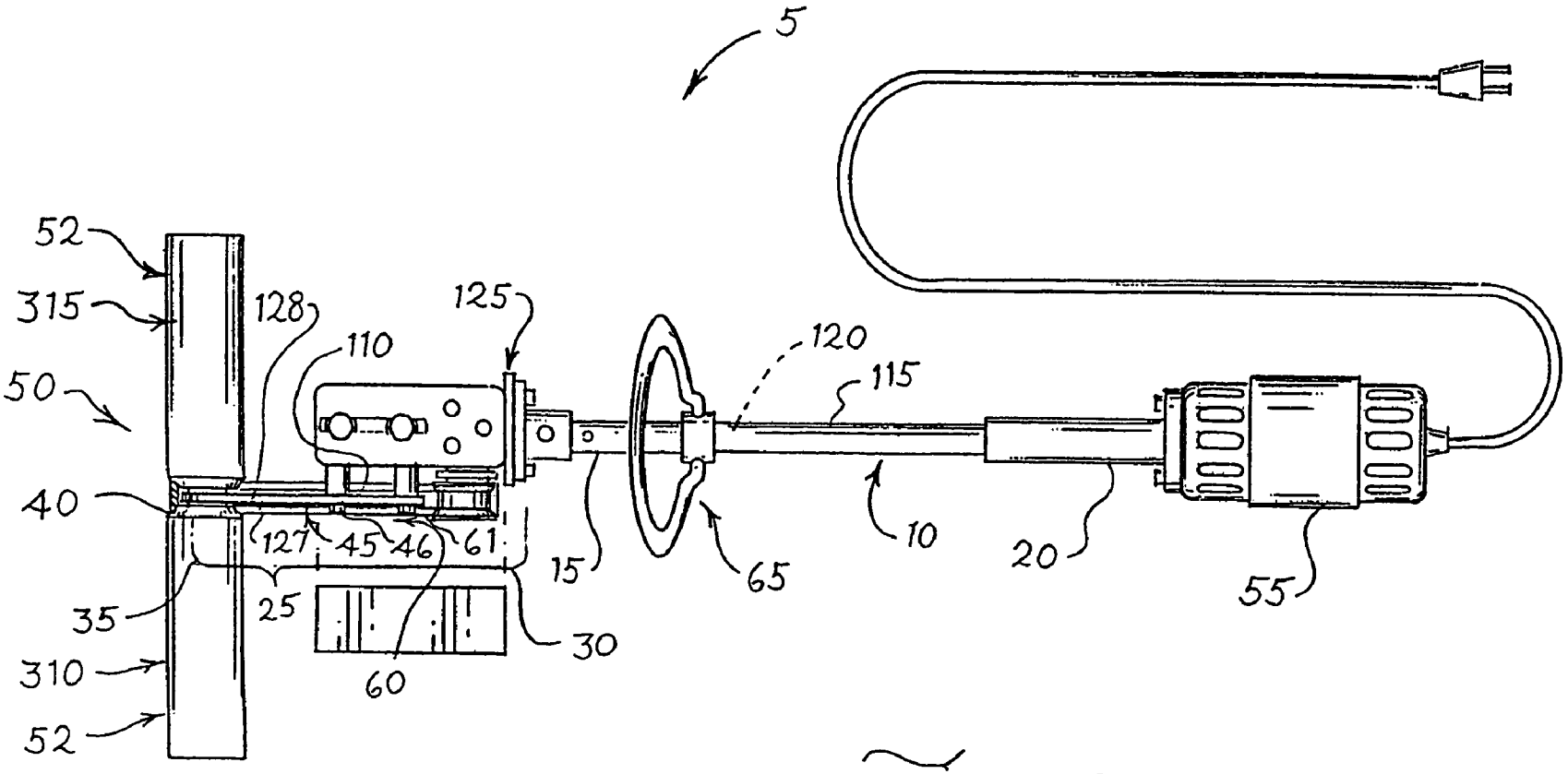
FIG. 2 is a plan view of an alternate embodiment of the extendable scrubber having a framework defining the at least forward and rearward ends of at least one arm and illustrating the motor, gearbox and related components.

This relates generally to devices used in the removal of excess spray-applied insulation from building components, and more particularly to an improved rotary scrubber that is readily extendable for reaching areas of extended elevation. FIGS. 1 and 2 each illustrate the basic components of respective alternate embodiments of the extendable scrubber 5. As illustrated therein, the extendable scrubber 5 comprises a housing 10 defining forward and rearward ends 15 and 20, and a framework 25 having first and second ends 30 and 35, with the second end of the framework defining at least a forward end 40 of at least one arm 45, illustrated as a single arm 46. In the embodiment of FIG. 1, the first end 30 of the framework 25 is connected to the housing 10, with the connection of the framework to the housing of the embodiment of FIG. 2 preferably comprising a removable connection. The scrubber 5 further comprises a roller assembly 50, comprised of at least one roller 52, rotatably associated with the at least a forward end 40 of the at least one arm 45, with a motor 55 connected to the housing 10 and operably associated with at least one drive belt 60, illustrated as drive belt 61 in FIGS. 1 and 2. The at least one drive belt 60 (belt 61 shown in section in FIG. 2 to better illustrate the arm 46 of the at least one arm 45) is operably associated with the roller assembly 50.

Figure 3:
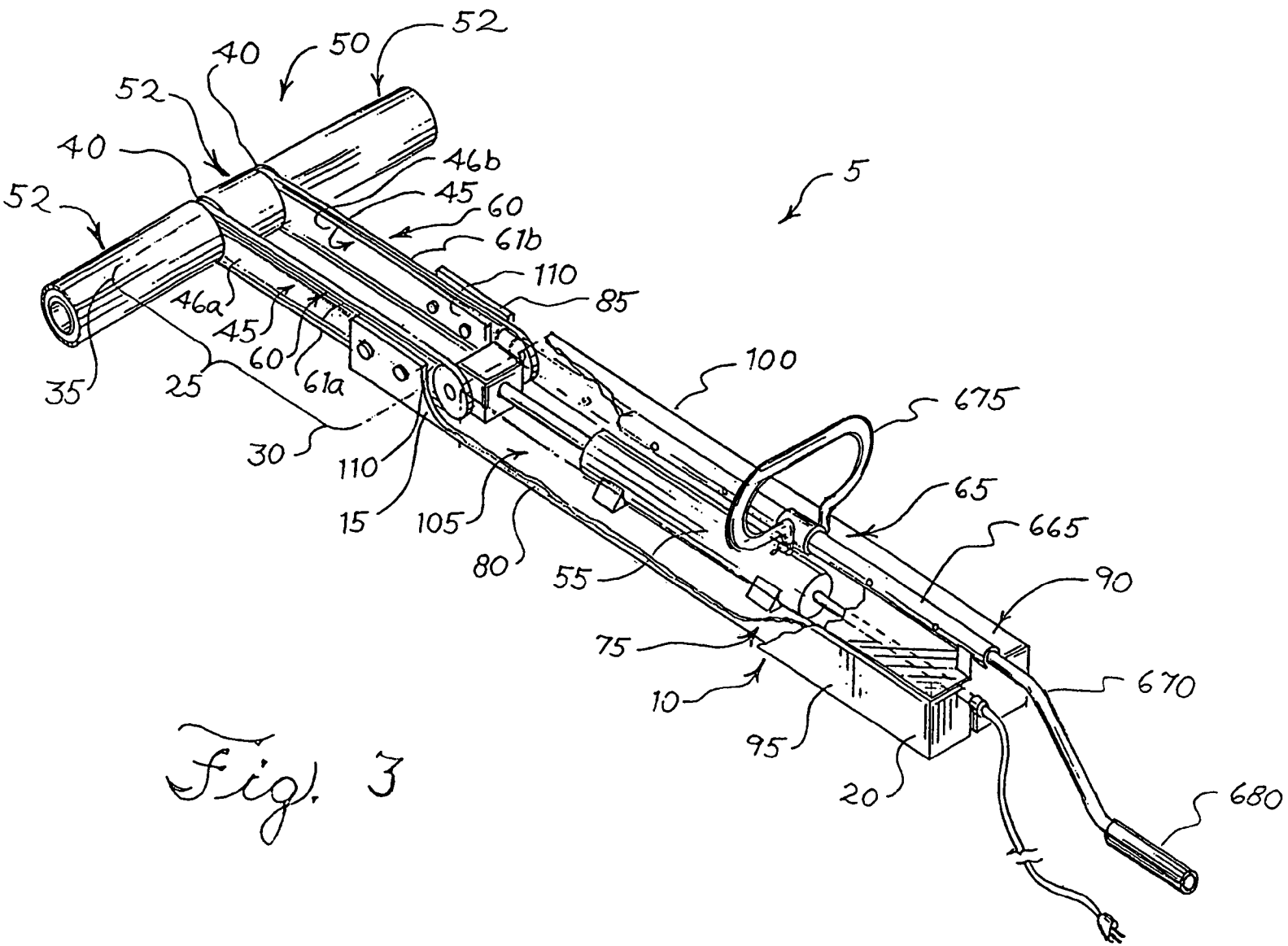
FIG. 3 is a perspective view of one embodiment of the extendable scrubber having a framework defining the at least forward and rearward ends of two arms of the at least at least one arm, with a portion of the housing removed to better illustrate the motor and related components.
Figure 4:
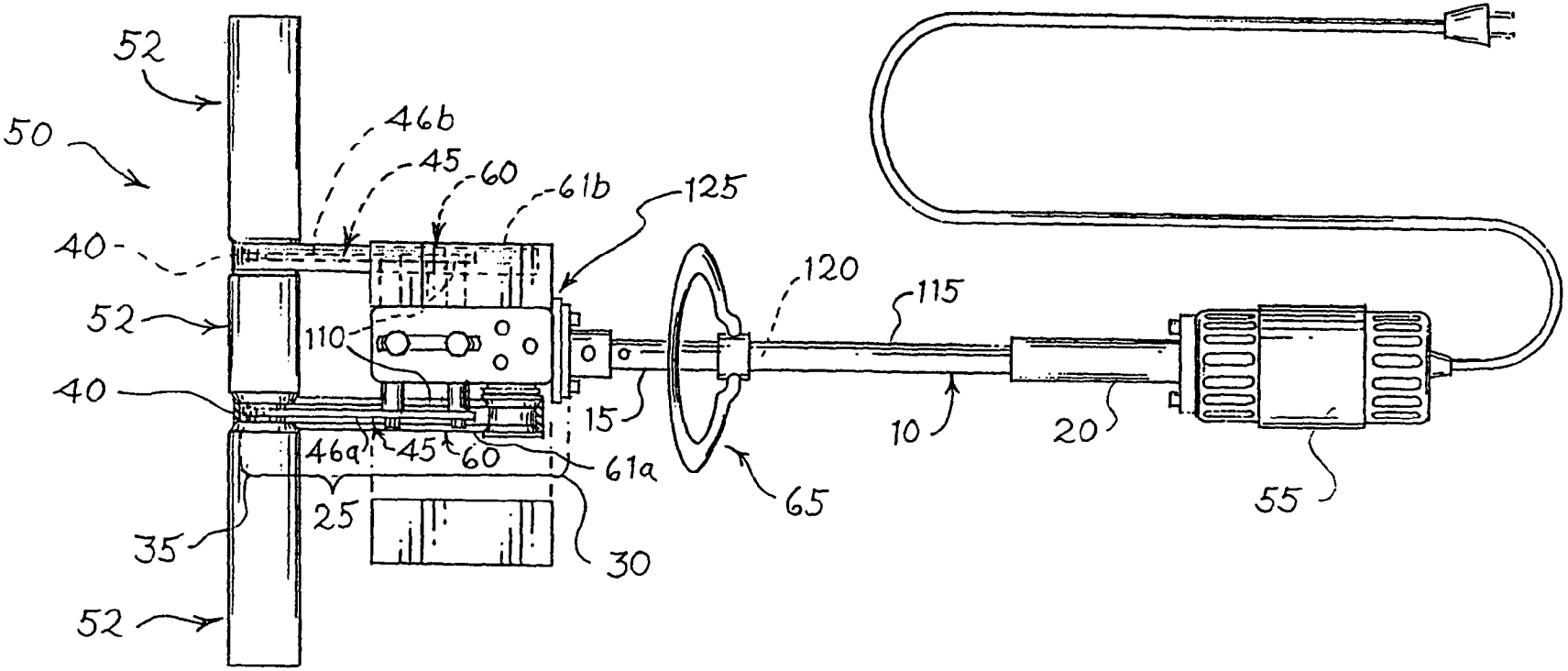
FIG. 4 is a plan view of an alternate embodiment of the extendable scrubber having a framework defining the at least forward and rearward ends of two arms of the at least one arm and illustrating the gearbox of the framework, as well as the motor and related components.

FIGS. 3 and 4 illustrate by example embodiments of scrubbers 5 defining the at least forward ends 40 of multiple arms of the at least one arm 45. Although the figures illustrate the at least forward ends of two arms 46*a* and 46*b* of the at least one arm 45, it is understood that other scrubber embodiments can utilize the at least forward ends of any number of arms. As illustrated therein, the extendable scrubber 5 comprises a housing 10 defining forward and rearward ends 15 and 20, and a framework 25 having first and second ends 30 and 35, with the second end of the framework defining the at least forward ends 40 of the arms 46*a* and 46*b* of the at least one arm 45. In the embodiment of FIG. 3, the first end 30 of the framework 25 is again connected to the housing 10, with the connection of the framework to the housing of the embodiment of FIG. 4 again preferably comprising a removable connection. The scrubber 5 further comprises the roller assembly 50, comprised of at least one roller 52, rotatably associated with the at least forward ends 40 of the arms 46*a* and 46*b* of the at least one arm 45, with a motor 55 connected to the housing 10 and operably associated with drive belts 61*a* and 61*b* of the at least one drive belt 60. Each drive belt 61*a* and 61*b* of the at least one drive belt 60 (belt 61*a* shown in section in FIG. 4 to better illustrate the arm 46*a* of the at least one arm 45) is operably associated with the roller assembly 50.

In a variation of the embodiments of the scrubber 5 illustrated in FIGS. 3 and 4, the second end 35 of the framework 25 defines at least forward ends 40 of at least a pair of arms 46*a* and 46*b*. The first end 30 of the framework 25 is again connected to the housing 10, with the connection of the framework to the housing of the embodiment of FIG. 4 again preferably comprising a removable connection. The roller assembly 50, again comprised of at least one roller 52, is rotatably associated with the at least forward ends 40 of the at least a pair of arms 46*a* and 46*b*, with a motor 55 connected to the housing 10 and operably associated with at least a pair of drive belts 61*a* and 61*b*. The at least a pair of drive belts 61*a* and 61*b* is operably associated with the roller assembly 50.

To extend the reach of the respective scrubbers 5, the scrubbers of FIGS. 1 and 3 further comprise an adjustable handle assembly 65 connected to the housing 10 while the scrubbers of FIGS. 2 and 4 further comprise at least one extender 70 (see FIG. 24) optionally removably connectable between the housing 10 and the framework 25, with the at least one extender operably associating the at least one drive belt 60 (i.e., drive belt 61 or drive belts 61*a* and 61*b*) with the motor 55 when connected there-between. The scrubbers of FIGS. 2 and 4 may also include an adjustable handle assembly 65 connected to the housing 10 to facilitate a gripping of the scrubber by users. Also, for the scrubbers 5 of FIGS. 1-4, each at least one drive belt 60 (i.e. drive belt 61 of FIGS. 1 and 2; drive belts 61*a* and 61*b* of FIGS. 3 and 4) is preferably entrained around the at least a forward end 40 of each at least one arm 45 (i.e. arm 46 of FIGS. 1 and 2; arms 46*a* and 46*b* of FIGS. 3 and 4) to prevent a gouging of the excess insulation during scrubbing procedures. However, it is understood that each at least one drive belt 60 may be located on the respective scrubber and not entrained around the at least a forward end of each arm as well.

As illustrated in FIGS. 1 and 3 in one embodiment of the extendable scrubber 5, the housing 10, illustrated with a portion removed to better show the scrubber's other components, preferably comprises a lower portion 75 having first and second sides 80 and 85 and an upper portion 90 having respective first and second sides 95 and 100, with both portions defining an enclosure 105. The upper portion 90 preferably defines a cover that is preferably removable from the lower portion 75 to allow access to the enclosure 105. The first end 30 of the framework 25 is preferably connected to the forward end 15 of the housing 10. As illustrated therein, the first end 30 of the framework 25 preferably defines at least a rearward end 110 of the at least one arm (i.e., arm 46 or arms 46*a* and 46*b*) with the at least a rearward end of the at least one arm connected to the housing (i.e. rearward end or ends 110 preferably connected to the side 80 or sides 80 and 85, respectively).

In the alternate embodiments of FIGS. 2 and 4, the housing 10 preferably comprises a housing ferrule member 115 having ends defined by the housing's forward and rearward ends 15 and 20, and an inner cylindrical surface 120. The first end 30 of the framework 25 preferably comprises a gearbox 125 connected thereto and adapted for removable connection with either the housing 10 or the at least one extender 70 (see FIG. 24). It is understood however, the gearbox 125 of the framework 25 is not removably connected to the housing 10 in scrubber embodiments not having a removable connection between the housing and the framework. As illustrated therein, the framework 25 preferably defines the at least rearward ends 110 of the arm 46 or arms 46*a* and 46*b* of the at least one arm 45, with such rearward ends located preferably proximal to the gearbox 125 of the framework.

The housing 10 of FIGS. 1-4 is comprised of any rigid material capable of supporting the remaining components of the scrubber 5. In one embodiment, the housing 10 is comprised of aluminum because of its rigid, lightweight and corrosion-resistant properties. However, it is understood that various other rigid materials may be utilized as well for the housing, to include various ferrous and non-ferrous metals and/or alloys, high strength plastic materials or composite materials, etc. The framework 25, defining the at least a forward end 40 of the at least one arm 45, is also preferably comprised of aluminum, again because of its rigid, lightweight and corrosion-resistant properties. However, it is again understood that other rigid materials may be utilized as well for the framework, to include various ferrous and non-ferrous metals and/or alloys, high strength plastic materials or composite materials, etc.

Figure 5:
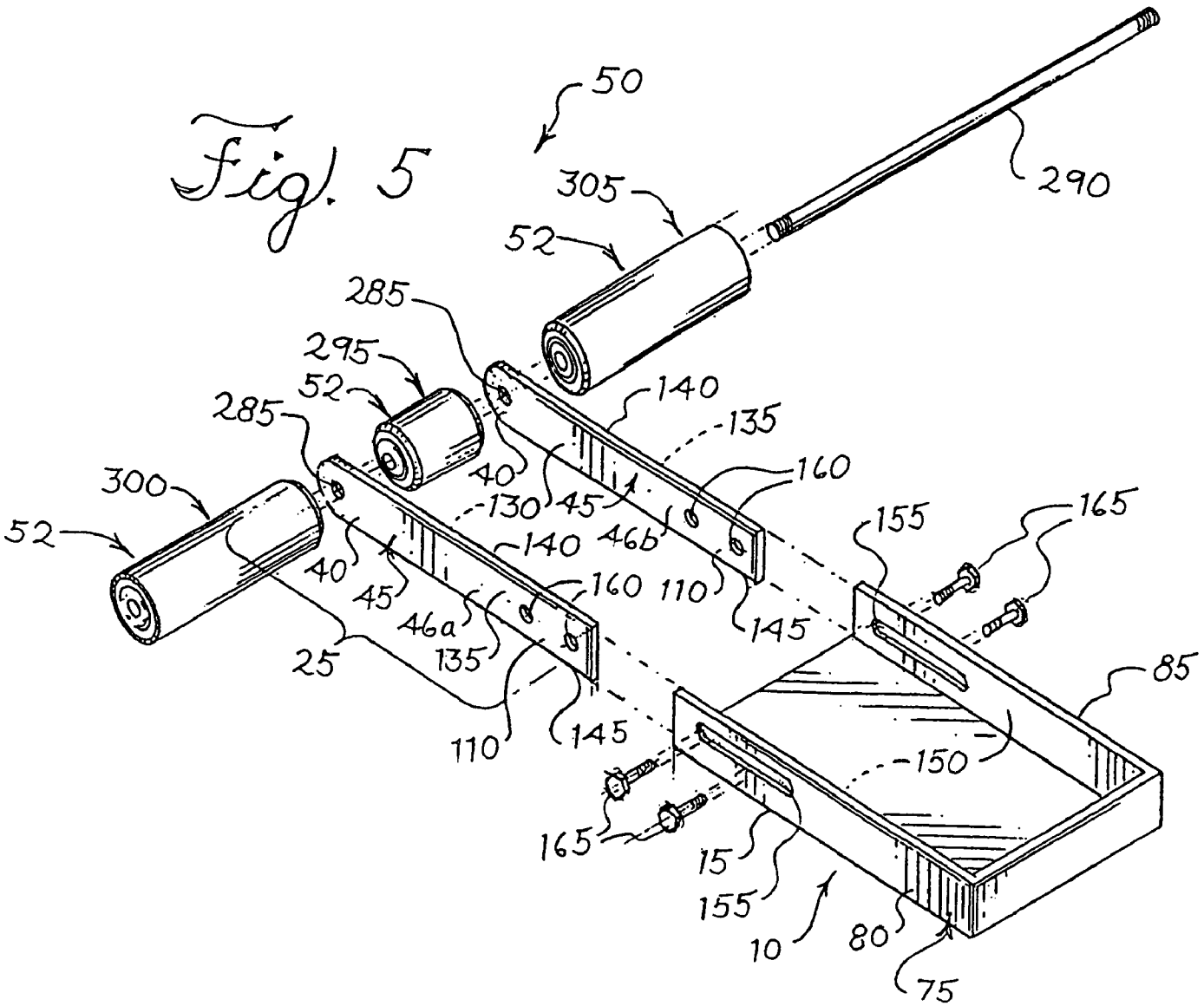
FIG. 5 is a perspective assembly view of the housing, framework, roller assembly and shaft of the extendable scrubber of FIG. 3.
Figure 6:
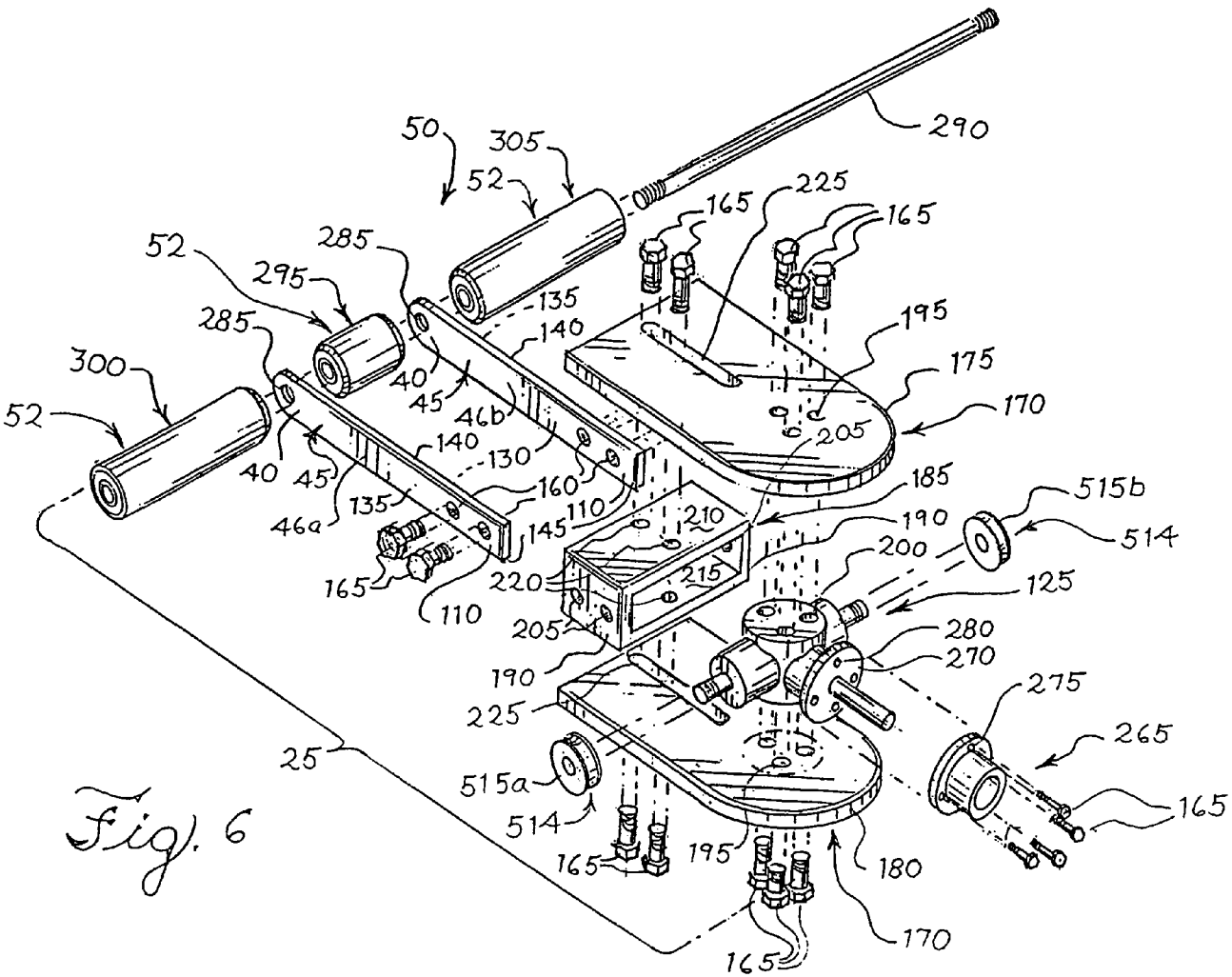
FIG. 6 is a perspective assembly view of the framework, roller assembly and shaft of the extendable scrubber of FIG. 4.

FIG. 5 is an assembly view illustrating the roller assembly 50, the framework 25 defining the at least forward and rearward ends 40 and 110 of the arms 46*a* and 46*b*, and the housing 10 of the extendable scrubber 5 illustrated in FIG. 3. FIG. 6 illustrates the roller assembly 50, as well as the gearbox 125 and the at least forward and rearward ends 40 and 110 of the arms 46*a* and 46*b* of the framework 25 of the scrubber 5 illustrated in FIG. 4. As illustrated in both figures, in addition to the framework 25 defining at least forward and rearward ends 40 and 110 of the arms 46*a* and 46*b* of the at least one arm 45, the framework also defines the inner and outer sides 130 and 135 and upper and lower edges 140 and 145 of the ends of the respective arms as well. For the framework 25 defining at least forward and rearward ends 40 and 110 of a single arm 46 of the at least one arm 40, the framework defines opposite sides 127 and 128 of the arm in addition to the upper and lower edges 140 and 145 (see FIGS. 1 and 2).

Referring to FIG. 5, the at least rearward ends 110 of the arms 46*a* and 46*b* of the at least one arm 45 are preferably connected at the forward end 15 of the housing 10 such that the outer sides 135 of the arm ends are located preferably adjacent to the inner surfaces 150 defined respectively by the sides 80 and 85 of the lower portion 75 housing 10. A longitudinal slot 155 is preferably defined in each side of the housing 10 that is co-aligned with a pair of bores 160 respectively defined in each at least rearward arm end 110. The respective bores 160 are preferably threaded and adapted to accept a pair of bolts 165 through the slots 155 to secure the at least rearward arm ends 110 of the framework 25 to the housing 10. The slots 155 allow for an adjustable translation of the at least rearward ends 110 of the arms 46*a* and 46*b* and bolts 165 in relation to the housing 10 such that, in one embodiment, the at least a rearward end of the at least one arm of the framework 25 is adjustably connected to the housing to facilitate the adjustment of the tension of the belts 61*a* and 61*b* of the at least one belt 60.

However, it is understood that the slots 155 may be respectively defined in the at least rearward ends 110 of the arms 46*a* and 46*b* and the bores 160 defined in housing's sides 80 and 85 to facilitate the same adjustment as well. It is further understood that the pair of bores may be defined in place of the slots 155 of each housing side, for alignment with the bores 160 of arms 46*a* and 46*b*, such that the connection of the at least rearward ends of the arms to the housing 10 via the bolts is not adjustable. Furthermore, although FIG. 5 illustrates the relationship between the housing 10 and the at least rearward ends of the arms 46*a* and 46*b* of the at least one arm 45 defined by the framework, it is understood that the at least a rearward end of a single arm of the at least one arm defined by the framework would have a similar relationship with the housing as well.

Referring to FIG. 6, the framework 25, in one embodiment, further comprises a brace 170 defining upper and lower portions 175 and 180 connected to the gearbox 125, and at least one bracket 185 preferably adjustably connected to the brace and defining opposing outer ends 190. The gearbox 125 is preferably connected between the brace upper and lower portions 175 and 180 via a plurality of bolts 165 that extend through bores 195 defined in the portions and into threaded bores 200 defined in the gearbox. In the embodiment of FIG. 6, the framework 25 defines the at least a rearward end 110 of the at least one arm 45 (i.e., ends 110 of arms 46*a* and 46*b*), with the at least a rearward end of the at least one arm preferably connected to the at least one bracket 185. The at least rearward ends 110 of the arms 46*a* and 46*b* of the at least one arm 45 are connected to the at least one bracket 185 such that the inner sides 130 of the arms are located preferably adjacent to the outer ends 190 of the at least one bracket. A pair of bores 160 is preferably defined in each arm end 110 that is co-aligned with horizontal threaded bores 205 defined in the outer ends 190 of the at least one bracket 185. The threaded bores 205 are each adapted to accept the insertion of a pair of bolts 165 through the bores 160 to secure the at least rearward ends 110 of the arms 46*a* and 46*b* of the at least one arm 45 to the at least one bracket 185.

The at least one bracket 185 also preferably defines upper and lower portions 210 and 215, with both portions defining a pair of threaded vertical bores 220 centrally located therein. The vertical bores 220 of the at least one bracket are aligned with a lengthwise slot 225 defined in the upper and lower portions 175 and 180 of the brace 170 such that a pair of bolts 165 is threadedly associated with the vertical bores through the slot. Thus, the connection of the at least one bracket 185 to the brace 170 is preferably adjustable. The slot 225 allows for an adjustable translation of the at least rearward ends 110 of the arms 46*a* and 46*b* of the at least one arm 45, via the at least one bracket 185 and bolts 165 in relation to the gearbox 125, such that the arm ends and gearbox of the framework are adjustably connected to one another. Thus, the connection between the gearbox to the remaining framework is adjustable to facilitate the adjustment of the tension of the at least one drive belts 60.

However, it is understood that the framework 25 may further comprise sides between the upper and lower portions 175 and 180 of the brace 170, in place of the at least one bracket 185, with bores or slots defined in the sides for co-alignment with bores or slots defined in the arms, to facilitate the adjustable or non-adjustable connection of the at least rearward ends of the arms to the gearbox via the bolts as well. It is also understood that the at least one bracket 185 may comprise a plurality of bracket components 192 connected to the at least rearward ends 110 of the arms 46*a* and 46*b* of the at least one arm 45 (see FIG. 20). It is further understood that although FIG. 6 illustrates the gearbox 125 as having the upper and lower portions 175 and 180 of the brace 170 connected thereto via bolts 165, with the bolts extending through bores 195 defined in the upper and lower portions of the brace and threadedly engaged with bores 200 defined in the gearbox, it is understood that the upper and lower portions of the brace may be unitary with the gearbox as well.

Figure 7:
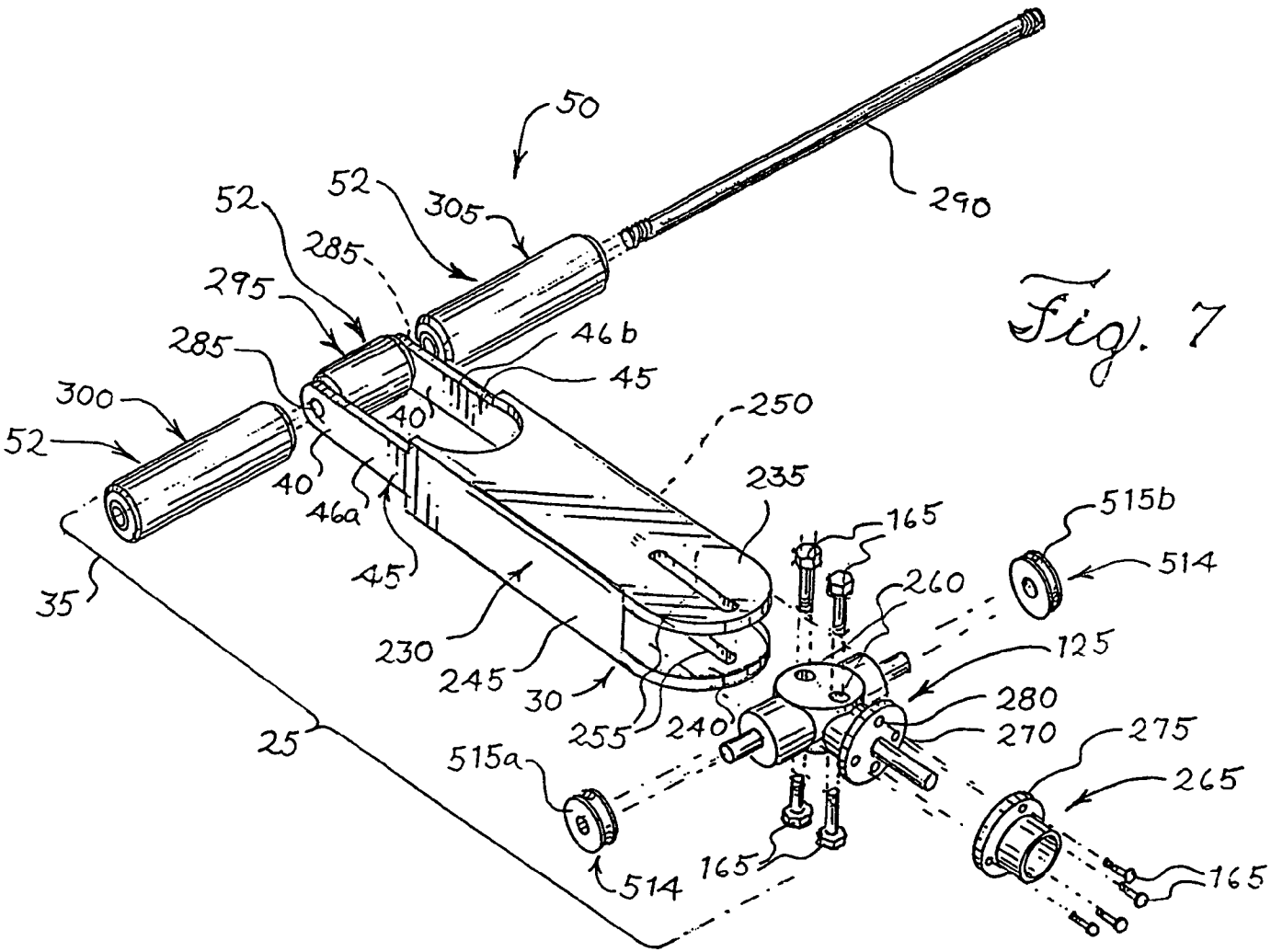
FIG. 7 is a perspective assembly view of illustrating an alternate embodiment of the framework of FIG. 6 having a unitary first end.

In yet another embodiment of the framework of FIG. 6, the at least one bracket and brace of the framework 25 may be unitary to define a unitary portion 230 at the framework's first end 30 for connection with the housing 10 via the framework's gearbox 125. FIG. 7 thus illustrates the framework 25 having first and second ends 30 and 35, with the second end of the framework again defining the at least forward ends 40 of the arms 46*a* and 46*b* of the at least one arm 45. The first end 30 of the framework 25 thus defines the unitary portion 230 having the gearbox 125 connected thereto. The unitary portion 230 defined at the first end 30 of the framework 25 preferably defines upper and lower members 235 and 240 located between opposite sides 245 and 250. A slot 255 is preferably defined in the respective upper and lower members 235 and 240 for co-alignment with threaded bores 260 of the gearbox 125, located there-between, to facilitate an adjustable connection between the gearbox and the remaining framework via bolts 165. Thus, the connection of the unitary portion 230 to the gearbox 125 is preferably adjustable. It is understood, however, that bores may be substituted for the slots defined in the unitary portion to facilitate the non-adjustable connection of the gearbox to the remaining framework as well.

As illustrated in FIGS. 6 and 7, the framework 25 further comprises a receiver 265, defined on the gearbox at a rearward end 270 thereof, to facilitate the connection of the housing 10 and/or at least one extender 70 to the framework (to be further discussed). Although FIGS. 6 and 7 illustrate the gearbox 125 as having the receiver 265 connected thereto via bolts 165 extending through bores 275 defined in the receiver and engaged with threaded bores 280 defined in the gearbox, it is understood that the receiver may be unitary with the gearbox as well.

Although FIGS. 5-7 each illustrate the components of the framework 25 connected to the housing 10 and to one another, respectively, via a plurality of bolts 165, it is understood that screws, rivets, or other similar fasteners may be utilized as well. It is also understood that welds or similar bonds may be utilized in place of or in addition to such fasters to connect the components of framework to the housing and to one another as well. Also, although FIGS. 5 and 6 illustrate the framework 25 as defining the at least rearward ends 110 of two arms 46*a* and 46*b* of the at least one arm 45 connected to the housing 10 and located proximal to the gearbox 125, it is understood that the at least a rearward end of a single arm 46 of the at least one arm 45 would have a similar relationship with the respective components as well. Furthermore, while FIG. 7 illustrates a framework 25 defining the at least forward ends 40 of the arms 46*a* and 46*b* of the at least one arm 45 along with the unitary portion 230, it is understood that the at least a forward end of a single arm 46 of the at least one arm 45 may be defined with the unitary portion as well.

It is further understood that while FIG. 7 illustrates the framework 25 defining the unitary portion 230 for use with the scrubber embodiments of FIGS. 2 and 4, the framework defining the unitary portion is also suitable for use with the scrubber embodiments of FIG. 1 and 3 as well. With such embodiments, the unitary portion 230, defined at the first end 30 of the framework in lieu of the at least rearward arm ends 110, is adjustably connected to the forward end 15 of the housing 10 of FIGS. 1 and 3. For example, the slots 255 defined in the respective upper and lower members 235 and 240 of the unitary portion 230 may be co-aligned with threaded bores (not shown) defined on the respective upper and lower portions 71 and 70 of the housing's forward end 15, with the upper and lower portions of the housing 10 located there-between and secured thereto with bolts extending though the slots and into the bores. The connection between the unitary portion 230 of the framework 25 and the housing 10 may be non-adjustable as well by utilizing bores defined in the upper and lower members of the unitary portion that are co-aligned with the bores defined in the upper and lower portions of the housing. In another example, bores (not shown) may be defined in the opposite sides 245 and 250 of the unitary portion 230 to facilitate the respective adjustable connection of the frame's first end 30 with the slots 155 of the respective sides 80 and 85 of forward end 15 of the lower housing portion 75 of FIG. 5, via the bolts 165. Again, bores may be utilized in place of the slots of the lower housing to facilitate a non-adjustable connection between the components as well.

As illustrated by example in FIGS. 5-7, the at least a forward end 40 of each arm 46*a* and 46*b* of the at least one arm 45 defines a through, roller assembly bore 285 that accommodates a roller assembly shaft 290 to define the rotatable association of the roller assembly 50 with the at least a forward end of the at least one arm, to be further discussed. The framework 25 of the embodiments illustrated in FIGS. 5-7 preferably defines a length between its first end 30 and the roller assembly bores 285 defined in the at least forward ends 40 of the arms 46*a* and 46*b* of the at least one arm 45 of from about 6 inches to about 12 inches.

In the embodiment of FIG. 5, the framework 25 preferably defines a length between the first end 30 and the roller assembly bores 285 of about 10 inches. In the embodiments of FIGS. 6 and 7, the framework 25 preferably defines a length between the first end 30 and the roller assembly bores 285 of about 8 inches, with the first end of FIG. 6 defining the at least rearward ends 110 of the arms 46*a* and 46*b* of the at least one arm 45. However, it is understood that the foregoing lengths are equally applicable to the framework of FIG. 7 defining the unitary portion 230 at the first end 30. To ensure an adequate rigidity of the arm ends of FIGS. 5-7, each preferably defines a width of from about 1/16 of an inch to about 3/8 of an inch, and more preferably about 1/8 of an inch. The arm ends of the figures each preferably have a depth between each arm's upper and lower edges 140 and 145 of from about 1 inch to about 5 inches. However, it is noted that the depth of each arm end (i.e. at least the forward end) is preferably less than the diameter of the at least one roller of the roller assembly (to be further discussed in relation to FIG. 14).

Referring again to FIGS. 5-7, for embodiments of the extendable scrubber 5 having a framework 25 defining the at least forward ends 40 of the arms 46*a* and 46*b* of the at least one arm 45, the roller assembly 50, comprised of at least one roller 52 and rotatably associated with the at least forward ends 40 of the arms, is illustrated as preferably comprising a central roller 295 and two outer rollers 300 and 305 of the at least one roller. The central roller 295 is located between the at least forward ends 40 of the arms 46*a* and 46*b* while the two outer rollers 300 and 305 are axially aligned with the central roller and located outwardly of the arm ends. For embodiments of the extendable scrubber 5 having a framework 25 defining the at least a forward end 40 of only a single arm 46 of the at least one arm 45, the roller assembly 60 is illustrated in FIGS. 1 and 2 as preferably comprising first and second rollers 310 and 315 of the at least one roller 52 that are axially aligned and located adjacent to opposite sides of the arm end.

Although FIGS. 1 and 2 illustrate the roller assembly 50 as comprising two rollers (i.e. first and second rollers 310 and 315) of the at least one roller 52 rotatably associated with the arm 46 of the at least one arm 45, it is understood that the roller assembly may comprise a single roller of the at least one roller located to one side of the arm. Also, although FIGS. 3 and 4 illustrate the roller assembly 50 as having three rollers (i.e., the central roller 295 and outer rollers 300 and 305) of the at least one roller 52 rotatably associated with the arms 46*a* and 46*b* of the at least one arm 45, it is understood that the roller assembly may comprise a single roller (i.e. a central roller alone) of the at least one roller located between the arms.

Regardless of whether the extendable scrubber utilizes a single arm or a pair of arms, the roller assembly 50 has an overall length of from about 2 inches to about 60 inches, preferably from about 18 inches to about 62 inches. For scrubbers utilizing a single arm, each of the first and second rollers have a length of from about 1 inch to about 30 inches, preferably from about 9 inches to about 31 inches. For scrubbers utilizing a pair of arms, the central roller has a length of from about 2 inches to about 62 inches, preferably about 3 inches, with each outer roller having a length of from about 1 inch to about 29.5 inches.

Figure 8:
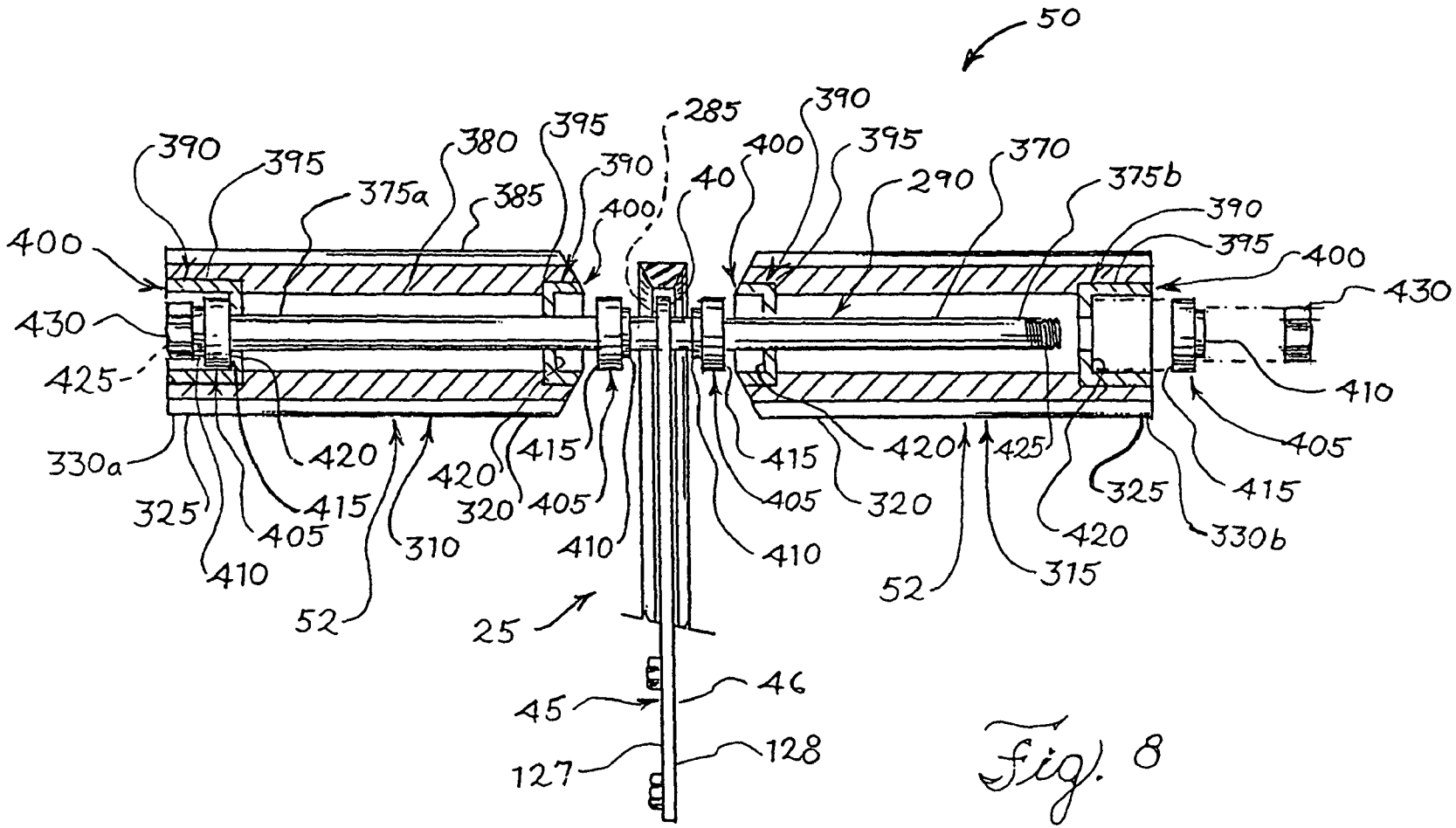
FIG. 8 is a sectional assembly view of the roller assembly of FIGS. 1 and 2 illustrating its relationship with the drive belt, shaft and arm end.
Figure 9:
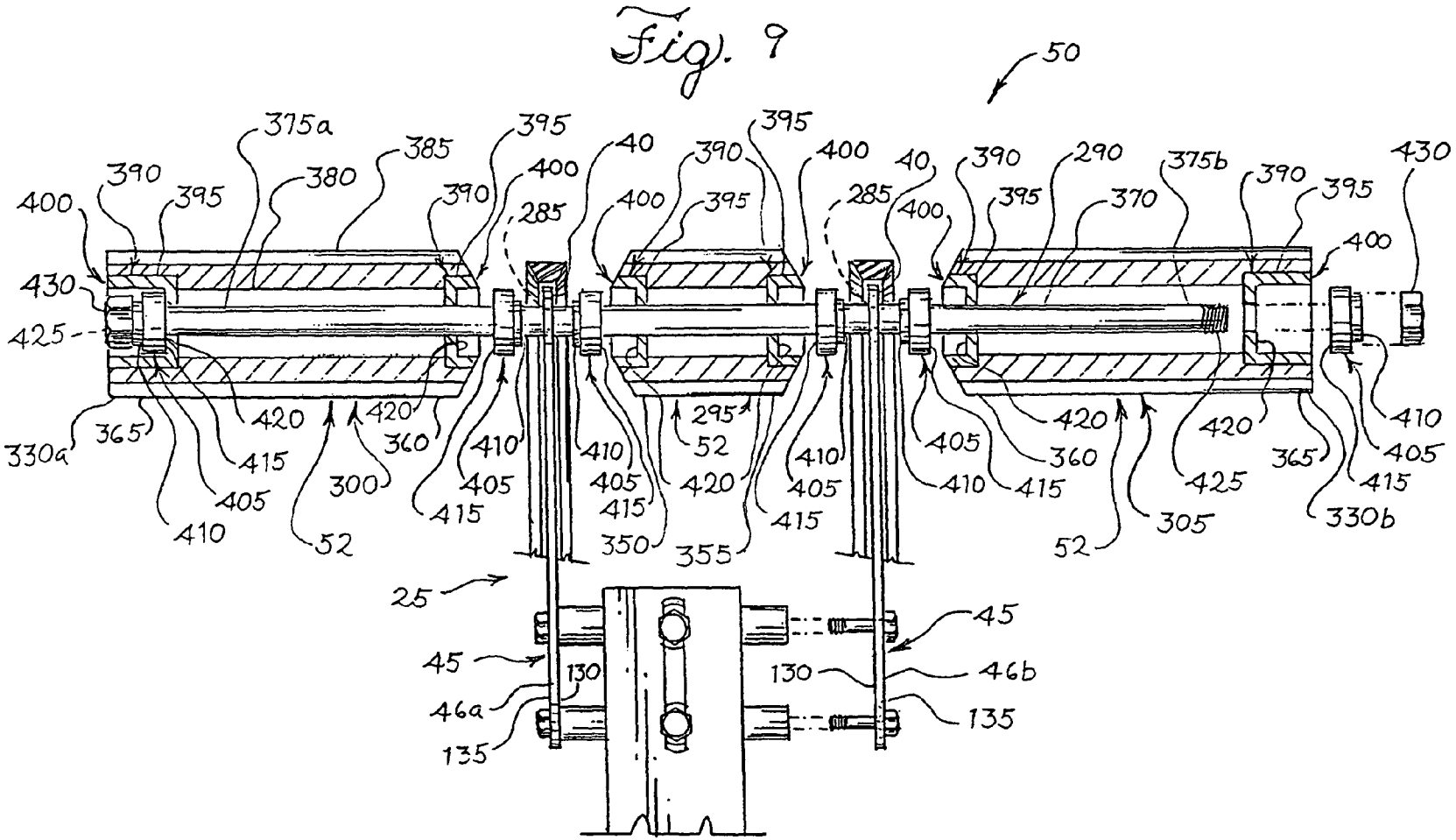
FIG. 9 is a sectional assembly view of the roller assembly of FIGS. 3 and 4 illustrating its relationship with the drive belts, shaft and arm ends.

FIGS. 8 and 9 are respective sectional assembly views of the roller assemblies 50 of the extendable scrubbers 5 of FIGS. 1-4. As illustrated in FIG. 8 in relation to extendable scrubbers 5 having a framework 25 defining the at least a forward end 40 of a single arm 46 of the at least one arm 45, the roller assembly 50 preferably comprises the first and second rollers 310 and 315 of the at least one roller 52 rotatably associated with the at least a forward end of the arm, with each roller defining inner and outer ends 320 and 325. The inner ends 320 of the respective rollers 310 and 315 are located proximal to the forward end 40 of the arm 46 while the outer ends 325 thereof define opposite outer ends 330*a* and 330*b* of the roller assembly 50.

As illustrated in FIG. 9 in relation to extendable scrubbers 5 having a framework 25 defining the at least forward ends 40 of the arms 46*a* and 46*b* of the at least one arm 45, the roller assembly 50 preferably comprises the central roller 295 and the outer rollers 300 and 305 of the at least one roller 52 rotatably associated with the at least forward ends of the arms of the scrubber. The central roller 295 defines opposite ends 350 and 355 located proximal to the forward ends 40 of the arms 46*a* and 46*b*, with each outer roller 300 and 305 defining inner and outer ends 360 and 365. The respective inner ends 360 of the outer rollers 300 and 305 are preferably located proximal the forward ends 40 of the arms 46*a* and 46*b* while the respective outer ends 365 of each outer roller define the opposite outer ends 330*a* and 330*b* of the roller assembly 50.

As illustrated respectively in FIGS. 8 and 9, for scrubber embodiments defining the at least a forward end or ends 40 of either an arm 46 or arms 46*a* and 46*b* of the at least one arm 45, the roller assembly shaft 290, defining an outer surface 370 and opposite ends 375*a* and 375*b*, extends through the roller assembly bore 285 defined at the forward end of each arm. The shaft 290 also extends at least into each roller of the at least one roller 52 of the roller assembly 50 to define the rotatable association of the assembly with the at least a forward end 40 of the at least one arm 45 of the respective scrubbers 5.

Thus, for scrubbers 5 utilizing arm 46 of the at least one arm 45, the shaft 290 extends through the roller assembly bore 285 at the forward end 40 and at least into the first and second rollers 310 and 315 of the roller assembly 50 (FIG. 8). For scrubbers 5 utilizing arms 46*a* and 46*b* of the at least one arm 45, the shaft 290 extends through the roller assembly bore 285 at each forward end 40, into and through the central roller 295, and at least into the outer rollers 300 and 305 of the roller assembly 50 (FIG. 9). In both scrubber embodiments, each roller assembly bore 285 is preferably about 0.505 inches in diameter while the roller assembly shaft 290 preferably defines an outer surface 370 having a corresponding diameter of about 0.5 inches. It is understood, however, that bores and corresponding shafts of other diameters may be utilized as well.

For the scrubber embodiments utilizing either an arm 46 or arms 46*a* and 46*b* of the at least one arm 45 respectively illustrated in FIGS. 8 and 9, each at least one roller 52 of the roller assembly 50 preferably defines about a 1 and 1/4 inch inside diameter and about a 2 inch outside diameter to define inner and outer roller surfaces 380 and 385, respectively. However, in additional embodiments, each roller may define an outside diameter of between about 1 inch and about 5 inches to define the outer roller surface as well. A circumferal void 390, defining an inner circumferal surface 395 having a diameter greater than each roller's inside diameter but less than the outside diameter, is preferably defined in the opposite ends of each roller of the at least one roller 52 of the roller assembly 50. For the inner and outer ends 320 and 325 of the first and second rollers 310 and 315 (FIG. 8), as well as for the opposite ends 350 and 355 of the central roller 295 and inner and outer ends 360 and 365 of the outer rollers 300 and 305 (FIG. 9), a seat 400 is located in the circumferal void 390 that engages the circumferal surface 395, with the seat 400 accommodating the placement of at least a thrust bearing and race assembly 405 therein. The seats 400 are preferably comprised of aluminum, with each preferably bonded to the inner circumferal surfaces 395 of the respective rollers with an adhesive. However, it is understood that the seat 400 may be comprised of any lightweight, rigid material as well. It is further understood that the seat may be connected to the respective roller using a resistance fit of any mechanical means understood in the art. Each seat may also be unitary with or defined in each roller itself as well.

Each thrust bearing and race assembly 405 has an inner race and offset, outer race to define opposite bearing sides 410 and 415. Each thrust bearing and race assembly 405, located between the outer surface 370 of the roller assembly shaft 290 and the respective seat 400 of each roller of the at least one roller 52 of the roller assembly 50, allows the rollers of the roller assembly to thus rotate about the shaft. Each seat 400 defines an abutment 420 located at a predetermined distance from the end of each roller of the at least one roller 52. For each roller of the roller assembly 50, the abutment 420 is adapted for contact with the one side 415 of the thrust bearing and race assembly 405 (i.e., the side of the offset, outer race).

Referring respectively to the roller assemblies 50 of FIGS. 8 and 9, for the seats 400 located at the inner ends 320 of the first and second rollers 310 and 315 proximal to the sides 127 and 128 of the arm 46, as well as for those located at the opposite ends 350 and 355 of the central roller 295 and the inner ends 360 of the outer rollers 300 and 305 proximal to the inner and outer sides 130 and 135 of the arms 46*a* and 46*b*, respectively, the distance of a given abutment 420 from the ends of the rollers is less than the width of a given thrust bearing and race assembly 405. This reduced distance allows the other side 410 of the thrust bearing and race assembly 405 i.e. the side not in contact with a roller's abutment 420, to contact to the respective sides of the arms, thus precluding any rotational interference between the ends of the rollers with the arms when the roller assembly 50 and shaft 290 are secured to the arms themselves.

To secure the roller assembly 50 and shaft 290 to the arm 46 of FIG. 9 or to the arms 46*a* and 46*b* of FIG. 4, the shaft preferably defines threads 425 at its opposite ends 375*a* and 375*b* such that nuts 430 threaded thereto exert lateral forces against the sides of the thrust bearing and race assemblies 405 (via the sides 415 of the offset, outer race) located at the outer ends 325 of the first and second rollers 310 and 315 and at the outer ends 365 of the outer rollers 300 and 305, respectively. Thus, when the nuts 430 are fastened to the threaded ends of the roller assembly shaft 290 and against the thrust bearing and race assemblies 405 located at the outer ends of the respective roller assemblies, the forces created thereby are transmitted laterally through the rollers and remaining bearing assemblies via the abutments 420, and to the arm 46 or arms 46*a* and 46*b*, to secure each roller of the at least one roller of the assembly thereto while avoiding the occurrence of any rotational interference with adjacent roller ends.

Figure 10:
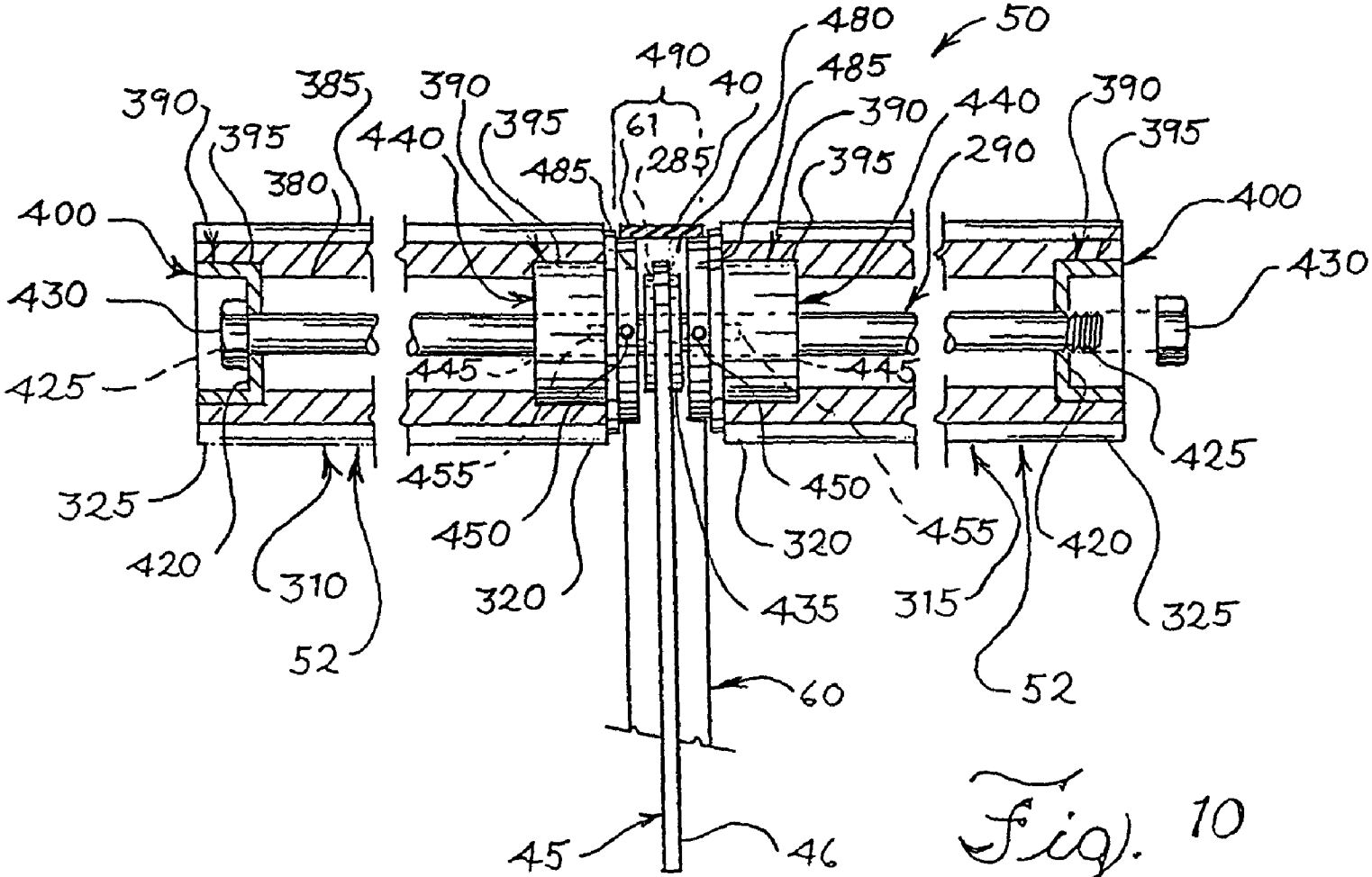
FIG. 10 is a sectional assembly view of the roller assembly FIGS. 1 and 2 illustrating an alternate relationship with the drive belt, shaft and arm end.
Figure 11:
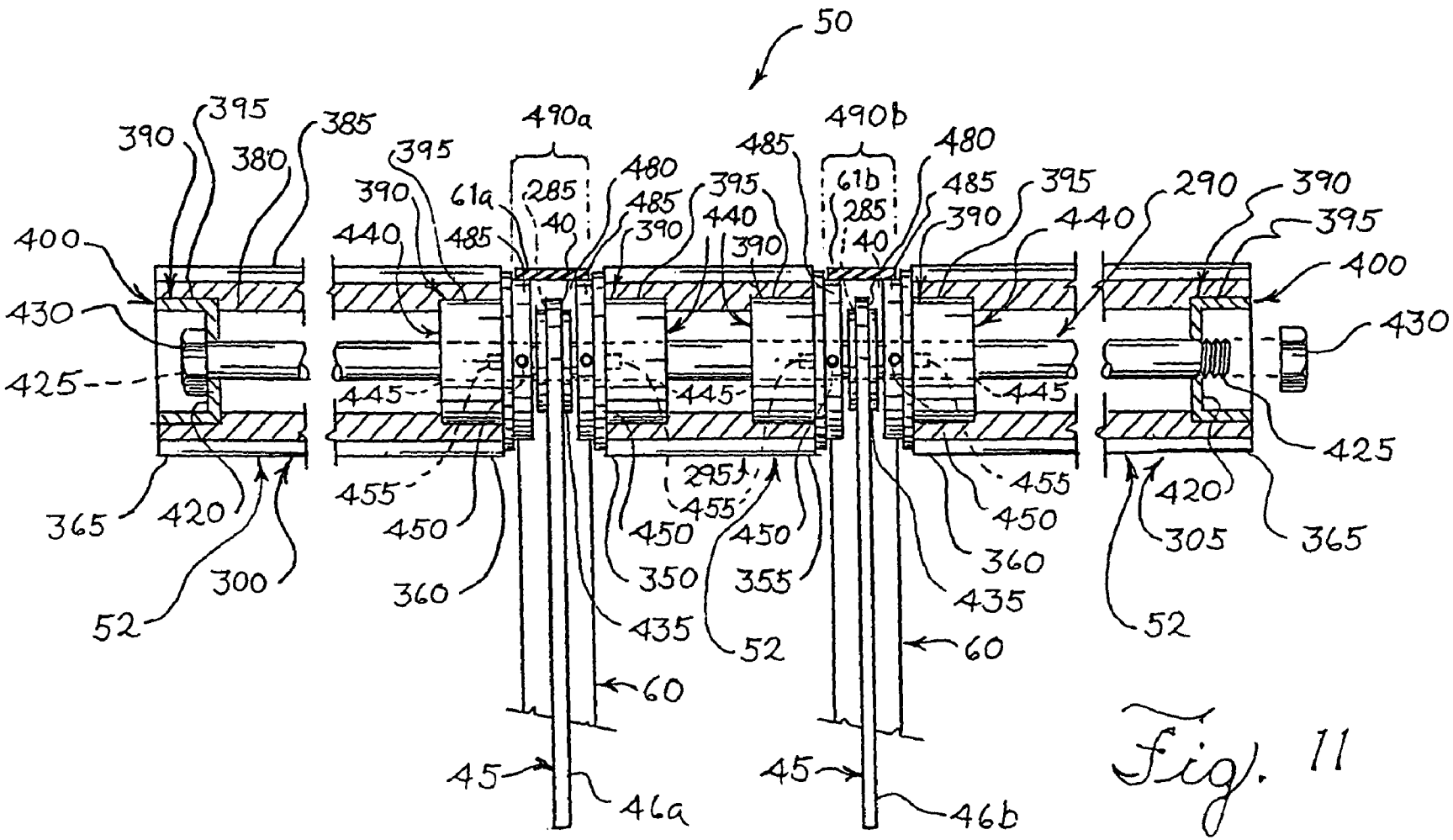
FIG. 11 is a sectional assembly view of the roller assembly FIGS. 3 and 4 illustrating an alternate relationship with the drive belts, shaft and arm ends.

While FIGS. 8 and 9 illustrate that each at least one roller 52 of the roller assembly 50 rotates about the shaft 290 connected to the at least forward ends 40 of the arm 46 or arms 46*a* and 46*b* of the at least one arm 45 of the scrubber via thrust bearing and race assemblies 405 located between the shaft and the respective seats 400 of each roller, FIGS. 10 and 11 illustrate each at least one roller of the roller assembly affixed to the shaft, with the shaft rotatably connected to the at least forward ends of the arms via one or more bearing and race assemblies located there-between. As illustrated therein, a press-fit bearing and race assembly 435 is located between the shaft 290 and the roller assembly bore 285 defined at the at least forward end 40 of the arm 46 or arms 46*a* and 46*b* of the at least one arm 45 to allow the shaft to rotate in relation thereto. Each at least one roller 52 of the assembly 50 again preferably defines about a 1 and ¼ inch inside diameter and about a 2 inch outside diameter to define inner and outer roller surfaces 380 and 385 respectively. Again however, in additional embodiments, each roller may define an outside diameter of between about 1 inch and about 5 inches to define the outer roller surface as well. A circumferal void 390, again defining an inner circumferal surface 395 having a diameter greater than each roller's inside diameter but less than the outside diameter, is again preferably defined at the opposite ends of each roller.

However, the circumferal voids 395 defined in at least the inner ends 320 of the respective first and second rollers 310 and 315 (FIG. 10), as well as in the opposite ends 350 and 355 of the central roller 295 and inner ends 360 of the respective outer rollers 300 and 305 (FIG. 11), each preferably accommodate the placement of a roller support 440 therein in lieu of the seat, with each roller support defining a support bore 445 therein adapted for mating engagement with the shaft 290. A set-screw 450 intersects the support bore 445 of each support 440 for engagement with a respective recess 455 defined on the shaft. Each set-screw 450, when engaged with an associated recess 455 of the shaft 290, thus releasably affixes each roller of the at least roller 52 of the roller assembly 50 to the shaft.

Because of the presence of the press-fit bearing and race assemblies 246 located between the respective arms and the shaft, the thrust bearing and race assemblies 405 are absent from the seats 400 located at the outer ends 325 of the respective first and second rollers 310 and 315 (FIG. 10) and at the outer ends 365 of the respective outer rollers 300 and 305 (FIG. 11), with the nuts 430 fastened to the threads 425 of the shaft and against the abutments 420 of the seats. Each roller support 440 is preferably comprised of aluminum and preferably bonded to the respective inner circumferal surfaces 395 of each roller with an adhesive. However, it is understood that the support may be comprised of any lightweight material as well. It is further understood that each may be connected to the respective roller using a resistance fit or any mechanical means understood in the art.

Figure 12:
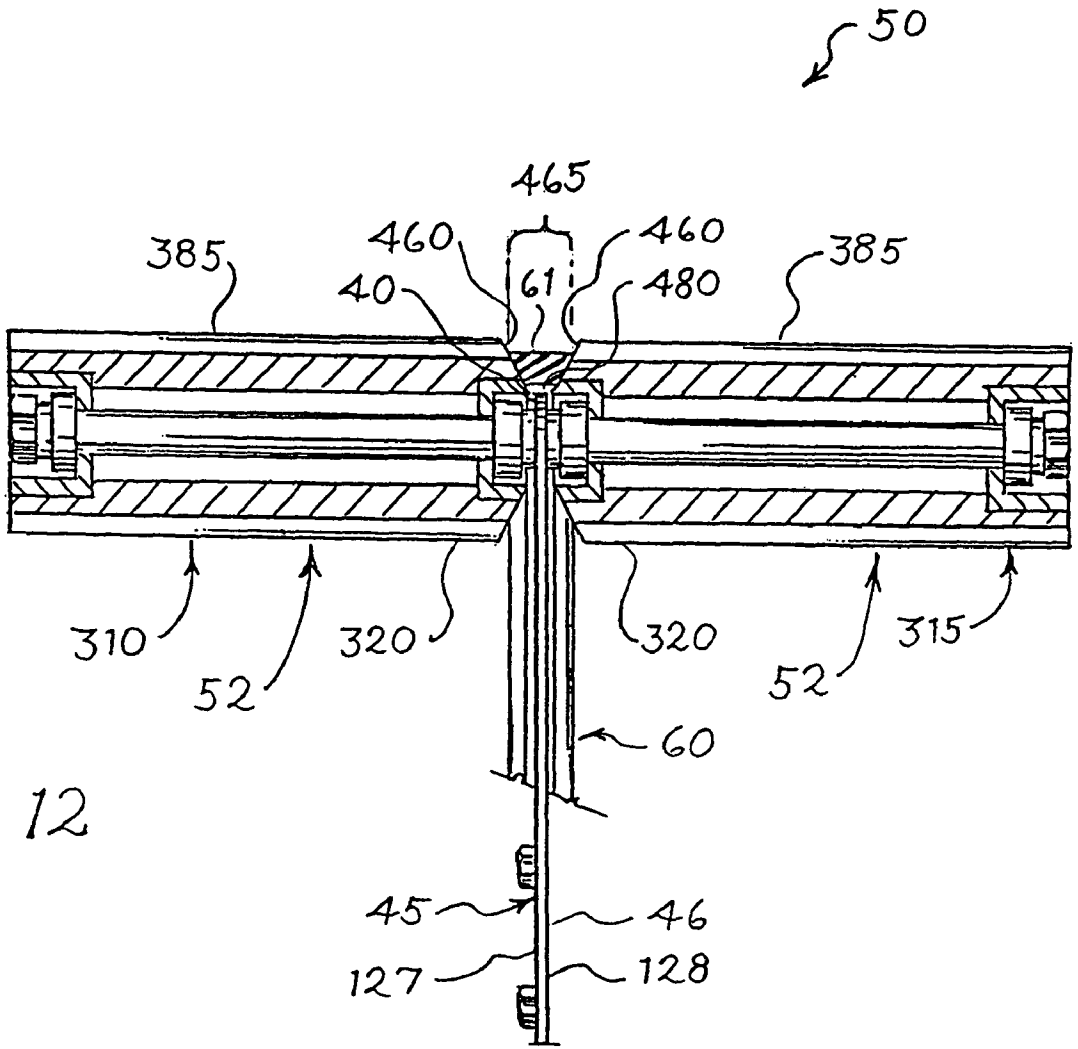
FIG. 12 is a sectional view of the roller assembly of FIGS. 1 and 2 illustrating the circumferal inlets defining the groove for the belt.
Figure 13:
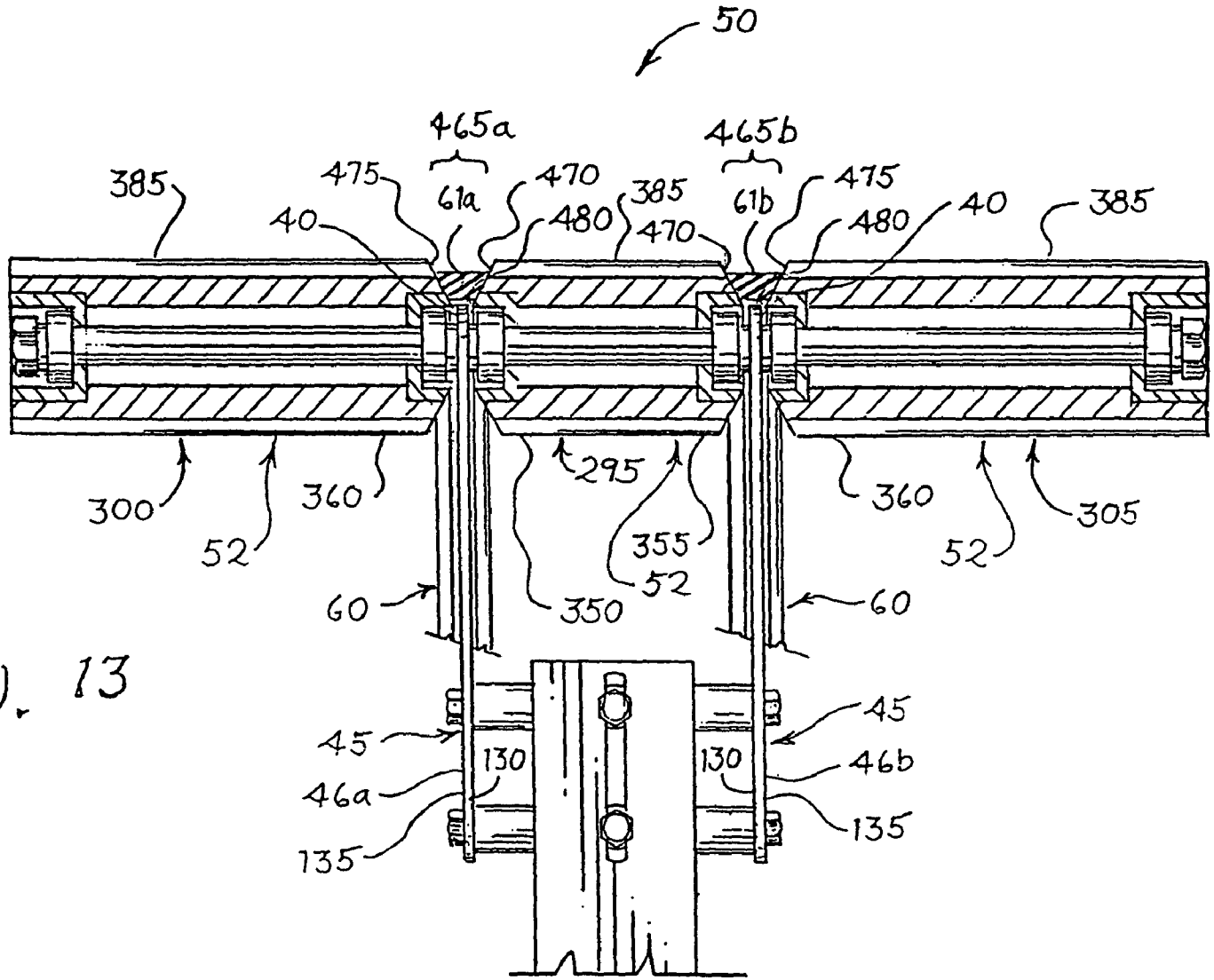
FIG. 13 is a sectional view of the roller assembly of FIGS. 3 and 4 illustrating the respective circumferal inlets defining the grooves for the belts.

In addition to having circumferal voids 390 defined in the rollers of the respective roller assemblies 50 to accommodate the respective seats 400 or roller supports 440, the at least one roller 52 of each assembly defines other features as well to accommodate the operable relation of the scrubber's at least one drive belt 60 therewith. Referring to FIG. 12, the inner ends 320 of the first and second rollers 310 and 315 located proximal to the sides 127 and 128 of the at least a forward end 40 of the arm 46 of the at least one arm 45 each define an inner circumferal inlet 460 in the outer surface 385 of the roller. The inner circumferal inlets 460 of the first and second rollers 310 and 315 together define a groove 465 in the roller assembly 50 for operable engagement with the drive belt 61 of the at least one drive belt 60. Referring to FIG. 13, the opposite ends 350 and 355 of the central roller 295 located proximal to the inner sides 130 of the at least forward ends 40 of the arms 46*a* and 46*b* of the at least one arm 45 each thus define an outer circumferal inlet 470 in the outer surface 385 of the roller. The inner ends 360 of the outer rollers 300 and 305 located proximal to the outer sides 135 of the at least forward ends 40 of the arms 46*a* and 46*b* of the at least one arm 45 each define an inner circumferal inlet 475 in the respective outer surfaces 385 of each roller. The outer and inner circumferal inlets 470 and 475 of the respective central 295 and two outer rollers 300 and 305 together define grooves 465*a* and 465*b* in the roller assembly 50 for operable engagement with the drive belts 61*a* and 61*b* of the at least one belt 60. The groove 465 of FIG. 12 and the grooves 465*a* and 465*b* of FIG. 13 thus define the operable relationship of each belt with the roller assembly 50 of each respective scrubber.

Each circumferal inlet defines a cross-section and depth such that their combination defines a groove 465 or grooves 465*a* and 465*b* having a cross-section and depth sufficient to accommodate the drive belt 61 or belts 61*a* and 61*b* of the at least one belt 60 therein. In the embodiments illustrated in FIGS. 12 and 13, each circumferal inlet preferably defines a downwardly sloped surface to define a groove 465 or grooves 465*a* and 465*b* having a substantially "V" or trapezoidal-shaped cross-section, thus accommodating a belt of like cross-section therein. However, it is understood that the circumferal inlets may define grooves having any cross-sectional shape to accommodate a belt of similar cross-section. For example, if the belt has a square or rectangular cross-section, then each circumferal inlet preferably defines a right angle to define a groove having a substantially square or rectangular cross-section. Similarly, if the belt has a circular cross-section, then each circumferal inlet preferably defines a groove having a cross-section defining a chord or semi-circle.

Figure 14:
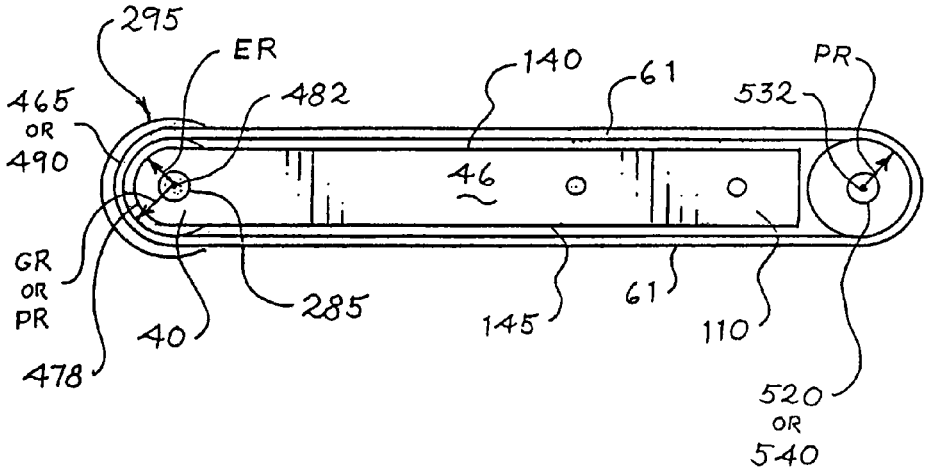
FIG. 14 is a side view of the at least forward and rearward arm ends illustrating their relationship with the central roller and drive belt.

Regardless of the shape of the groove cross-section defined by the circumferal inlets, as illustrated in FIGS. 12 and 13, because the groove 465 or grooves 465*a* and 465*b* of a given roller assembly 50 are defined by circumferal inlets located on opposite sides of the at least forward ends 40 of the arm 46 or pair of arms 46*a* and 46*b* of the at least one arm 45, a gap 480 is defined in each groove due to the presence of the arm end located there-between. Referring to FIG. 14 in addition to FIGS. 12 and 13, the at least a forward end 40 of the at least one arm (only arm 46, belt 61 and central roller 295 illustrated in FIG. 14 by example) preferably defines a rounded outer end 478 co-radial with the roller assembly bore 285 defined therein. To ensure that a given drive belt, when engaged with a given groove, does not contact the upper and lower edges 140 and 145 or rounded outer end 478 of a given arm located respectively within a given gap 480, the depth of each groove (i.e., groove 465) is defined by a groove radius GR, as measured from an axis 482 defined by the roller assembly bores 285 of the arm or arms, that exceeds the end radius ER of the arms' rounded ends defining each arm's top-to-bottom depth. Also, to ensure that the given drive belt engaged with a given arm is not drawn into the respective gap 480 defined therein, each groove defines a width that both accommodates the drive belt and exceeds that of the gap.

Alternatively, referring again to FIG. 10, the roller supports 440 located at the inner ends 320 of the first and second rollers 310 and 315 of the at least one roller 52 each define a pulley surface 485. The pulley surfaces 485 of the first and second rollers 310 and 315 together define a pulley 490 in the roller assembly 50 for operable engagement with the drive belt 61 of the at least one drive belt 60. Referring again to FIG. 11, the roller supports 440 located at the opposite ends 350 and 355 of the central roller 295 and at the inner ends 360 of the outer rollers 300 and 305 of the at least one roller 52 each define pulley surface 485 to define respective pulleys 490*a* and 490*b* in the roller assembly 50 for operable engagement with the drive belts 61*a* and 61*b* of the at least one drive belt 60. While FIGS. 12 and 13 illustrate a groove defined by inlets located at respective roller ends and while FIGS. 10 and 11 illustrate a pulley defined by the pulley surfaces of the roller supports located at respective roller ends, it is understood that the groove or pulley may be defined anywhere along the length of the roller as well.

Because the pulley 490 or pulleys 490*a* and 490*b* of the rollers of a given roller assembly 50 are defined by pulley surfaces located on opposite sides of the arm 46 or pair of arms 46*a* and 46*b* of the at least one arm 45, a gap 480 is again defined due to the presence of the arm located there-between. Referring again to FIG. 14, to ensure that a drive belt, when engaged with a given pulley, does not contact the upper and lower edges 140 and 145 or rounded forward end 478 of a given arm (only arm 46, belt 61 and central roller 295 illustrated by example) located respectively within a given gap 480, each pulley (i.e., pulley 490) defines a radius PR, again as measured from an axis 482 defined by the roller assembly bores 285 of the arm or arms, that the exceeds the end radius ER of the arms' rounded ends defining each arm's top-to-bottom depth. Also, to ensure that the given drive belt engaged with a given arm is not drawn into the respective gap 480 defined therein, each groove defines a width that both accommodates the drive belt and exceeds that of the gap.

The roller assembly 50, driven by the drive belt 61 or drive belts 61*a* and 61*b* of the at least one drive belt 60 to rotate against various insulation mixtures and building framing members, thus utilize rollers comprised of durable materials. In one embodiment, the at least one roller 52 of the roller assembly 50 is comprised of a polyurethane material having a durometer hardness range of between about 60 A and about 85 D, preferably about 75 D. It is understood, however, that polyurethane rollers of other durometer hardness may be utilized, as well as rollers comprised of other materials (i.e., aluminum, plastic, rubber, etc). To facilitate the removal of the excess insulation mixture from building cavities and from the faces of the structural members, the at least one roller 52 of the roller assembly 50 defines a textured outer surface. The textured outer surface may comprise any texture sufficient for the removal of sprayed insulation or other materials. In the embodiments illustrated in FIGS. 15-17, the at least one roller 52 of the roller assembly 50 preferably defines a plurality of ribs 495 in its outer surface 385. The outer surface 385 defines between about 15 and about 35 ribs, preferably about 22 ribs. The ribs 495 may be machined or cut into the outer surface 385 of each roller, or the ribs may be formed by a molding or extrusion process.

Figure 15:
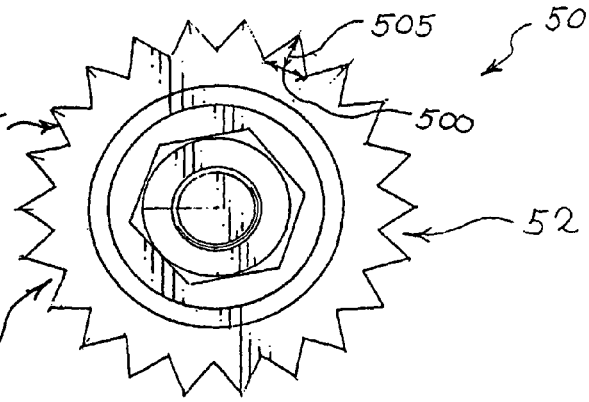
FIG. 15 is an end view of the at least one roller of the roller assembly having an outer surface defining ribs having a triangular cross-section.

FIG. 15 illustrates an embodiment of the at least one roller 52 of the roller assembly 50 wherein each rib 495 has a triangular cross-section. As illustrated therein, the triangular cross-section of each rib preferably defines a base 500 having a width of between about ⅛ of an inch and about ½ of an inch, more preferably about 3⁄16 of an inch, and a height 505 defining a radial distance from the base of between about ⅛ of an inch and about ¼ of an inch, more preferably about 3⁄16 of an inch. In one embodiment, the base 500 of each rib 495 is longitudinally co-terminus with one another such that no space exists circumferentially there-between. However, it is understood that in other embodiments, the base 500 of each rib 495 is not longitudinally co-terminus with one another such that a longitudinal space is defined there-between.

Figure 16:
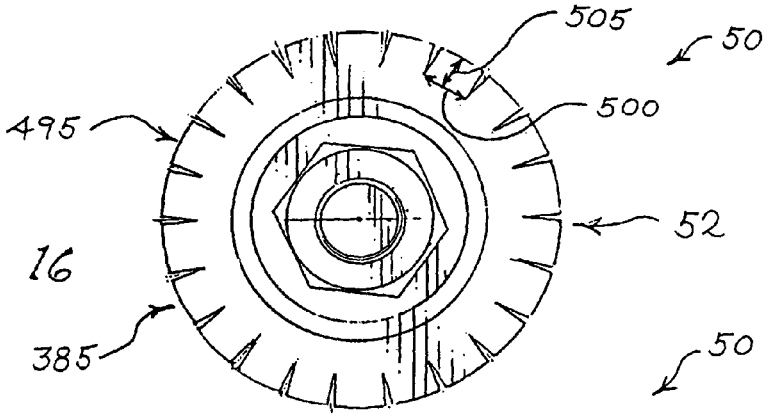
FIG. 16 is an end view of the at least one roller of the roller assembly having an outer surface defining ribs having a cross-section defining at least two right angles.

FIG. 16 illustrates an embodiment of the at least one roller 52 of the roller assembly 50 wherein each rib 495 has a cross-section defining at least two right angles. As illustrated therein, the cross-section of each rib 495 preferably defines a base 500 having a width of between about ⅛ of an inch and about ½ of an inch, more preferably about 3⁄16 of an inch, and a height 505 defining a radial distance from the base of between about ⅛ of an inch and about ¼ of an inch, more preferably about 3⁄16 of an inch. In one embodiment, the base 500 of each rib 495 is again longitudinally co-terminus with one another such that no space exists circumferentially there-between. However, it is understood that in other embodiments, the base 500 of each rib 495 is not longitudinally co-terminus with one another such that a longitudinal space is defined there-between.

Figure 17:
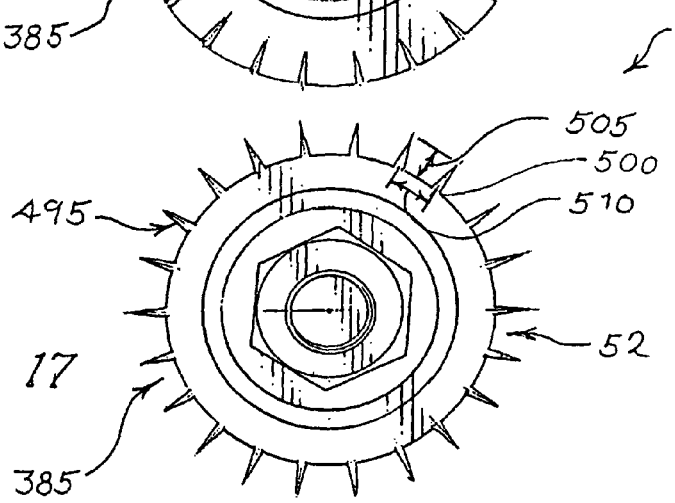
FIG. 17 is an end view of the at least one roller of the roller assembly having an outer surface wherein each rib has a cross-section defining a blade.

FIG. 17 illustrates an embodiment of the at least one roller 52 of the roller assembly 50 wherein each rib 495 has a cross-section defining a blade. As illustrated therein, the cross-section of each rib preferably defines a base 500. A spacing 510 of between about ⅛ of an inch and about ½ of an inch, more preferably about 3/16 of an inch, is defined between each rib 495 (i.e. blade). The cross-section of each rib also preferably defines a height 505 defining a radial distance from the base of between about ⅛ of an inch and about ¼ of an inch, more preferably about 3/16 of an inch.

Figure 18:
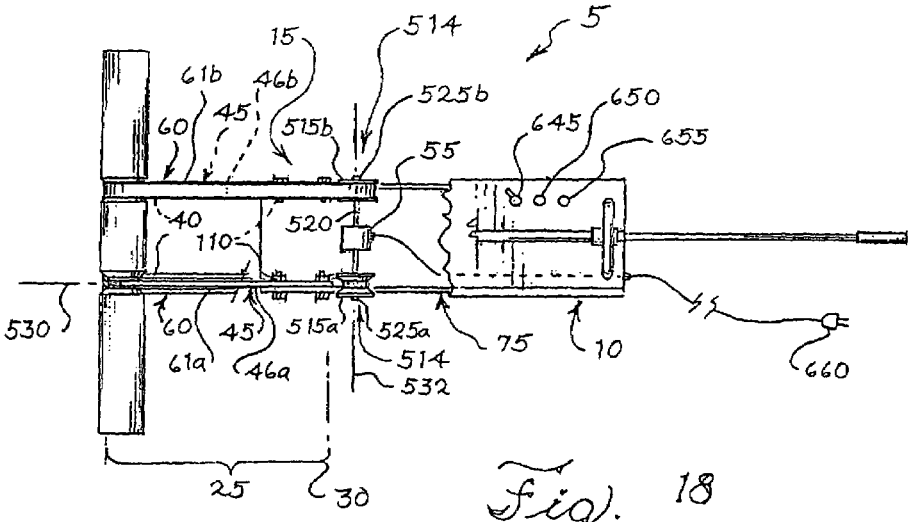
FIG. 18 is a plan view of the extendable scrubber of FIG. 3 having a portion of the housing removed to better illustrate one embodiment of the operable association of the motor with the drive pulleys.
Figure 19:
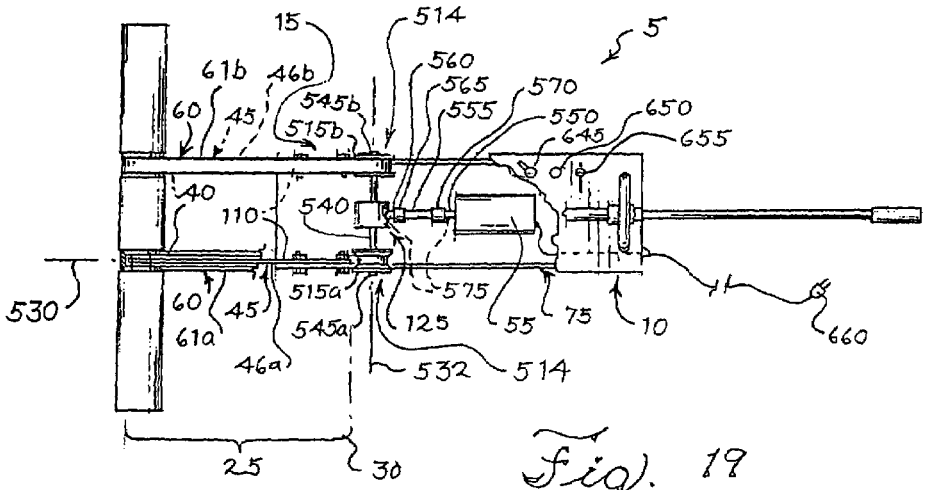
FIG. 19 is a plan view of the extendable scrubber of FIG. 3 having a portion of the housing removed to better illustrate another embodiment of the operable association of the motor with the drive pulleys.

The motor 55, preferably connected to the housing 10, is operably associated with the at least one drive belt 60 (i.e., drive belt 61 or drive belts 61*a* and 61*b*), with such operable association preferably comprising at least one drive pulley 514 (i.e., drive pulley 515 or drive pulleys 515*a* and 515*b*, respectively) operably engaging the at least one drive belt and driven by the motor, or driven by the gearbox 125 operably associated with the motor. FIGS. 18 and 19 illustrate alternate embodiments of the operable association of the motor with the drive belts of the scrubber of FIG. 3 while FIG. 20 better illustrates the operable association of the motor and drive belts of the scrubber of FIG. 4. While each of the aforementioned figures respectfully illustrate the operable association of the motor and gearbox with the drive belts 61*a* and 61*b* via drive pulleys 515*a* and 515*b*, it is understood that a single pulley 515 of that at lest one drive pulley 514 may be utilized to drive a single belt 61 of the at least one drive belt 60 as well (i.e., FIGS. 1 and 2).

In the embodiment of the scrubber 5 illustrated in FIG. 18, each at least one drive pulley 514 (i.e., drive pulleys 515*a* and 515*b*) is driven by the motor 55 and is operably engaged with each at least one drive belt 60 (i.e., belts 61*a* and 61*b*) to comprise the operable association of the motor with the at least one drive belt. The motor 55 drives the drive pulleys 515*a* and 515*b* of the at least one drive pulley 514 such that a double-ended output shaft 520 of the motor defining ends 525*a* and 525*b* has a pulley connected at each end. With this configuration, the motor 55 is preferably connected to the lower portion 75 of the housing 10 with screws, bolt or other common fasteners, preferably proximal to a forward end 15 thereof, with the output shaft 520 oriented transverse to the at least forward ends 40 of the arms 46*a* and 46*b* of the framework 25. The output shaft preferably has a shaft length such that the drive pulleys 515*a* and 515*b* of the at least one drive pulley 514 are located proximal to the first end 30 of the framework 25 (i.e. the at least rearward ends 110 of the arms 46*a* and 46*b* of the at least one arm 45) along an axis 530 defined through the at least a forward end 40 of each arm.

For scrubber embodiments utilizing a framework 25 defining a unitary portion 230 at its first end 30, the pulleys 515*a* and 515*b* of the at least one drive pulley 514 are located respectively proximal to the sides 245 and 250 of the unitary portion (see FIG. 7). In a variation of the embodiment of FIG. 18 (not shown), the motor 55 is located proximal to the forward end 40 of the at least one arm 45 and again utilizes a double-ended output shaft 520 defining ends 525*a* and 525*b* and oriented transverse to the end of the at least one arm. A roller of the roller assembly 50 (i.e. first and second rollers 310 and 315) is connected to each of the opposite shaft ends and is thus directly rotated by the motor.

In another embodiment of the scrubber 5 illustrated by example in FIG. 19, the at least one drive pulley 514 (i.e., drive pulleys 515*a* and 515*b*), is driven by a gearbox 125 connected to the housing 10 and operably associated with the motor 55, with each at least one drive pulley again operably engaged with each at least one drive belt 60 (i.e. belts 61*a* and 61*b*) to comprise the operable association of the motor with the at least one drive belt. With this configuration, the motor 55 is preferably connected to the lower portion 75 of the housing 10, with the motor's output shaft 550 preferably oriented parallel to the at least forward ends 40 of the arms 46*a* and 46*b* and driving the gearbox 125. The gearbox 125, preferably connected to the lower portion 75 of the housing 10 with screws, bolts or other common fasteners preferably proximal to the forward end 15 thereof, is a 90 degree gearbox preferably having a double-ended gearbox output shaft 540 oriented transverse to the arms and defining ends 545*a* and 545*b*.

The gearbox output shaft 540 has drive pulleys 515*a* and 515*b* of the at least one drive pulley 514 connected at its respective ends 545*a* and 545*b* and has a length such that the pulleys are again located proximal to the first end 30 of the framework 25 (i.e. the at least rearward ends 110 of the arms 46*a* and 46*b* of the at least one arm 45) along an axis 530 defined through the at least a forward end 40 of each arm. For scrubber embodiments utilizing a framework 25 defining a unitary portion 230 at its first end 30, the pulleys 515*a* and 515*b* or the at least one pulley 514 are located respectively proximal to the sides 245 and 250 of the unitary portion (see FIG. 7). Referring again to FIG. 19, the motor output shaft 550 of the motor 55 preferably drives the gearbox 125 via a drive link 555 located between the output shaft of the motor and the input shaft 560 of the gearbox. In one embodiment, the drive link 555 of the embodiment of FIG. 19 comprises a flexible coupling defining opposite ends 565 and 570. An inlet 575 is defined in each opposite end, with the inlets adapted to accept an insertion of the motor output shaft 550 and gearbox input shaft 560 respectively therein. A set-screw or similar fastener (not shown) is preferably utilized with each end of the drive link 55 to secure the respective ends 565 and 570 to the motor and gearbox shafts 550 and 560.

Figure 20:
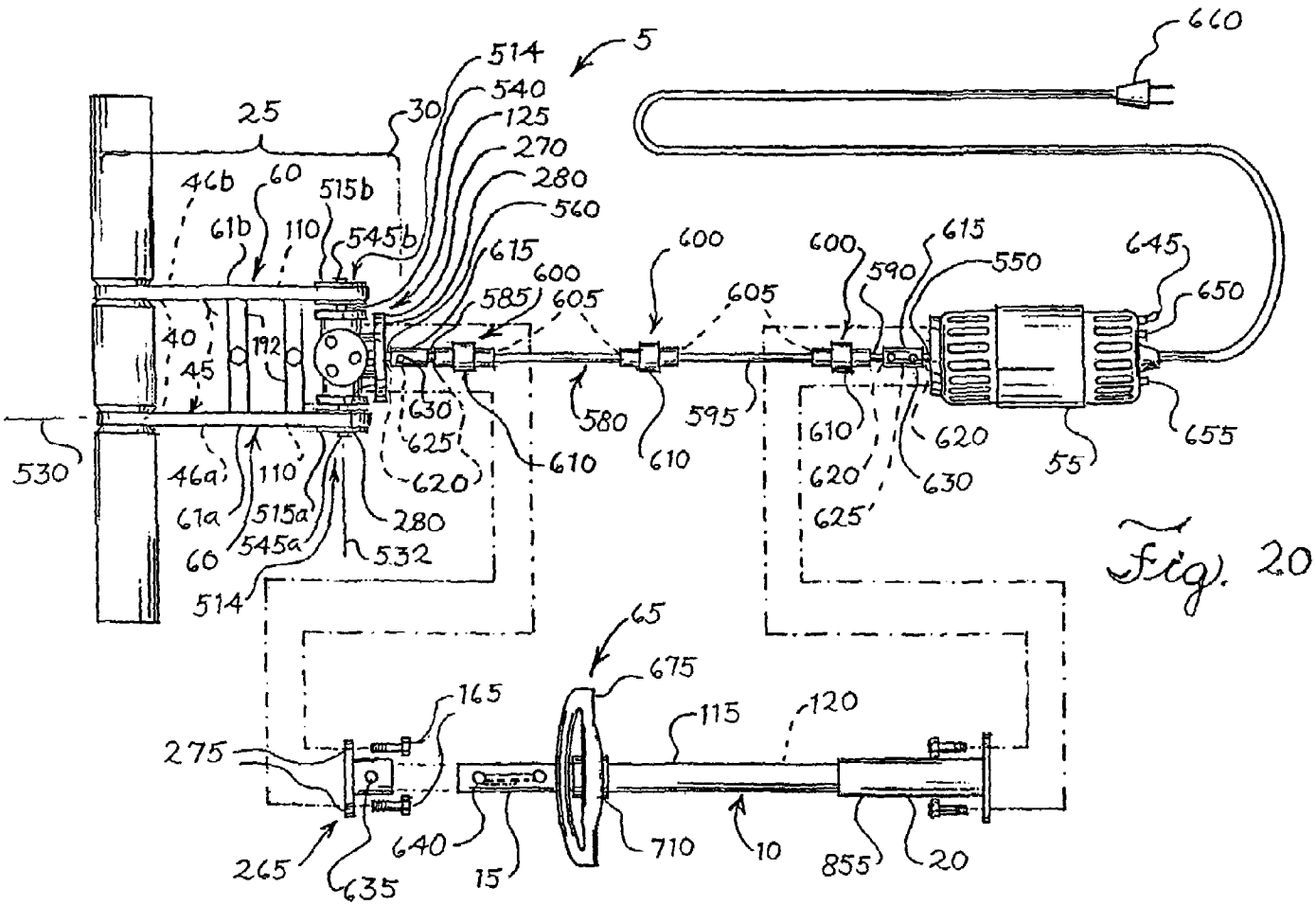
FIG. 20 is a plan view of the extendable scrubber of FIG. 4 having the housing removed to better illustrate another embodiment of the operable association of the motor with the drive pulleys.

In the embodiment of the scrubber 5 illustrated in FIG. 20, the gearbox 125 of the framework 25, operably associated with the motor 55, drives the at least one drive pulley 514 (i.e., drive pulleys 515*a* and 515*b*), with each at least one drive pulley again operably engaged with each at least one drive belt 60 (i.e., belts 61*a* and 61*b*) to comprise the operable association of the motor with the at least one drive belt. As illustrated therein, the motor 55 is preferably connected at the rearward end 20 of the housing 10 with the output shaft 550 of the motor oriented parallel to the at least forward ends 40 of the arms 46*a* and 46*b*. The gearbox 125 of the framework 25, with the at least rearward ends 110 of arms 46*a* and 46*b* located proximal thereto, is preferably connected at the forward end 15 of the housing 10,(or optionally the at least one extender 70 of FIG. 24, to be further discussed). The gearbox 125 again is a 90 degree gearbox preferably having a double-ended gearbox output shaft 540 oriented transverse to the arm ends and defining ends 545*a* and 545*b*.

The gearbox output shaft 540 again has drive pulleys 515*a* and 515*b* of the at least one drive pulley 514 connected at its respective ends 545*a* and 545*b* and has a length such that the pulleys are again located proximal to the first end 30 of the framework 25 (i.e. the at least rearward ends 110 of the arms 46*a* and 46*b* of the at least one arm 45) along an axis 530 defined through the at least a forward end of each arm. For scrubber embodiments utilizing a framework 25 defining a unitary portion 230 at its first end 30, the pulleys 515*a* and 515*b* of the at least one drive pulley 514 are located respectively proximal to the sides 245 and 250 of the unitary portion (see FIG. 7). Also, regardless of scrubber embodiment, the drive pulleys 515, 515*a* and 515*b* of the at least one drive pulley 514 preferably define a pulley groove radius PR (i.e. the radius of the pulley groove as measured from an axis 532 defined by the motor or gearbox output shaft 520 or 540) that exceeds the end radius of the rounded outer end 478 of each arm and thus the top-to-bottom depth of each to accommodate each respective belt therein while preventing an interference of each belt with the framework 25 (see FIGS. 14 and 18-20).

In a variation of the embodiment of FIG. 20 (not shown), the gearbox 125 is located proximal to the forward end 40 of the at least one arm 45 (at the second end 35 of the framework 25) and again is a 90-degree gearbox having a double-ended gearbox output shaft 540 oriented transverse to the end of the at least one arm. A roller of the roller assembly 50 (i.e. first and second rollers 310 and 315) is connected to each of the opposite shaft ends 545*a* and 545*b* and is thus directly rotated by the gearbox without the use of the at least one drive belt 60. The gearbox is driven by a motor connected to the housing via a shaft connected there-between.

As illustrated in FIG. 20, the housing 10 operably associates the gearbox 125 with the motor 55 wherein the housing preferably comprises the housing ferrule member 115 enclosing a housing drive link 580 (housing ferrule member shown removed from housing drive link to better illustrate the drive link). The output shaft 550 of the motor 55 preferably drives the gearbox 125 via the housing drive link 580 enclosed by the ferrule member 115 of the housing 10. The housing drive link 580 defines forward and rearward ends 585 and 590 and an outer cylindrical surface 595, with the rearward end of the link connected to the output shaft 550 of the motor 55 and the forward end of the link removably connected to an input shaft 560 of the gearbox 125. The ferrule member 115 of the housing and the housing drive link 580 located therein preferably have about a common length between their respective forward and rearward ends. In one embodiment, the housing 10, comprising the ferrule member 115 enclosing the housing drive link 580, has a length of from about 3 inches to about 60 inches, preferably from about 6 inches to about 24 inches, and more preferably about 24 inches. Thus, given that the housing ferrule member 115 and the housing drive link 580 have about common lengths, the housing ferrule member 115 and housing drive link 580 each have a length of from about 3 inches to about 60 inches, preferably from about 6 inches to about 24 inches, and more preferably about 24 inches.

To concentrically secure the housing drive link 580 within the ferrule member 115 of the housing 10, a plurality of spacers 600 are located along the drive link. Each spacer preferably comprises a ferrule bushing defining inner and outer cylindrical surfaces 605 and 610. The inner cylindrical surface 605 of each spacer 600 defines a diameter slightly greater than the diameter defined by the outer cylindrical surface 595 of the housing drive link 580 while the outer cylindrical surface 610 of each spacer defines a diameter slightly greater that the inside diameter defined by the inner cylindrical surface 120 of the housing ferrule member 115. The relationship between the respective diameters allows the housing drive link to rotate freely within each spacer 600 while each spacer is secured via a resistance fit within the housing ferrule member, thus concentrically securing the housing drive link within the housing.

In one embodiment, to facilitate the removable connection of at least the forward end 585 of the housing drive link 580 to the input shaft 560 of the gearbox 125, a coupling 615 is preferably located on the gearbox input shaft with the coupling preferably defining an inlet 620 adapted to accept both the gearbox input shaft and the forward end 585 of the housing drive link 580 therein. A threaded bore 625 is defined in the coupling 615 that is adapted to accept a hex screw 630 or similar fastener therein for tightening against the gearbox input shaft 560 inserted therein. The forward end 585 of the housing drive link 580 and the inlet 620 of the coupling 615 receiving it both preferably define a square or hexagonal shape adapted for mating engagement with one another to rotationally secure the drive link to the gearbox input shaft 560 via the coupling while allowing for a ready withdrawal of the drive link from within the coupling. The coupling 615 is also preferably located on the motor output shaft 550 with the coupling again preferably defining an inlet 620 adapted to accept both the motor output shaft and the rearward end 590 of the housing drive link 580 therein. Threaded bores 625 are defined in the coupling 615 that are adapted to accept hex screws 630 or similar fasteners therein for tightening against both the motor output shaft 550 and rearward link end 590 inserted therein to prevent their withdrawal from one another.

To facilitate the removable connection of at least the forward end 15 of the housing 10 to the gearbox 125 of framework 25, the receiver 265 of the gearbox, defined at the rearward end 270 thereof, is adapted to accept a removable insertion of the forward end 15 of the housing ferrule member 115 therein. The receiver 265 defines a transverse bore 635 therein adapted for engagement with a snap-pin 640 attached to the forward end 15 of the housing ferrule member 115 to removably secure at least the housing to the gearbox 125 of the framework 25. Thus, as illustrated therein, the removable connection of both the forward end 585 of the housing drive link 580 to the input shaft 560 of the gearbox 125, and the forward end 15 of the housing 10 to the gearbox itself, facilitates a removal of the framework 25 from the housing to allow for the optional utilization of the at least one extender 70, to be further discussed, between the housing and framework. However, it is understood that further embodiments of the scrubber of FIG. 20 may have a connection between the housing and framework that does not facilitate their removal from one another as well. Also, although FIG. 20 illustrates the gearbox 125 as having the receiver 265 connected to the rearward end 270 of the gearbox 76 via bolts 165 threadedly engaged with bores 280 defined in the gearbox through co-aligned bores 275 defined in the receiver, it is understood that the receiver may be unitary with the gearbox as well.

It is noted that in each of the embodiments illustrated in FIGS. 19 and 20, a 1:1 gear ratio is preferred for the gearbox. However, it is understood that gearboxes having other gear ratios may be utilized as well, depending upon the desired rotational rate of the roller assembly. Also, although a rigid shaft is preferably utilized for the drive link and housing drive link that respectively connect the motor to the gearbox, it is understood that a flexible shaft or other mechanism understood in the art, may be utilized as well. Furthermore, regardless of the scrubber embodiment, the motor 55 is preferably mounted to the housing 10 using common fasteners such as screws or bolts.

Also regardless of embodiment, the motor 55 preferably comprises a small-profile, high-torque and high-RPM (rotation per minute) motor preferably having an adjustable RPM and torque. In the one embodiment, the motor has a rotational rate of from about 500 RPMs to about 2000 RPMs, preferably about 1000 RPMs, and delivers from about 30 in-lbs of torque to about 50 in-lbs of torque, preferably about 31.5 in-lbs of torque. Because a 1:1 gear ratio is preferably utilized in the gearbox 125, these same rotational speeds and torques are transmitted to the rotating roller assembly 50 itself. However, it is understood that both the motor and gearbox output speeds and torques may be varied to achieve these same preferred speeds and torques at the roller assembly. It is also understood that various gear ratios other than 1:1 may be utilized in the gearbox to vary both the rotational speed and torque of the roller assembly as well. Controls for the motor, to include an on-off switch 645 and RPM and torque adjustment dials 650 and 655, are preferably located on the housing 10 (FIGS. 18 and 19) or the motor 55 (FIG. 20) of the scrubber 5 for ready access during scrubbing operations. A common 120 V electrical cord with plug 660 is connected to the motor 55 to facilitate its energization via any common 120 V electrical outlet or other source.

Referring again to the embodiment of FIGS. 1 and 3, to facilitate the scrubbing of insulation from areas of extended elevation, the scrubber 5 has an adjustable handle assembly 65 connected to the housing 10. The adjustable handle assembly 65 preferably comprises a receiver 665 connected to the housing 10 and an extension 670 and a support handle 675 adjustably connected with the receiver. The extension 670 preferably defines an extension handle 680, with the support handle 675 adjustably connected with the receiver 665 forward of the extension handle when the extension is adjustably connected with the receiver. The components of the adjustable handle may be comprised of aluminum, ferrous or non-ferrous metals or other alloys, plastic, composite materials or other materials having lightweight and rigid properties. The receiver 665 is preferably connected to the housing 10 using common fasters, such as nuts and bolts, screws, rivets, or other similar fasters. However, the receiver may be connected to the housing using welds, adhesive or other similar bonds as well.

Figure 21:
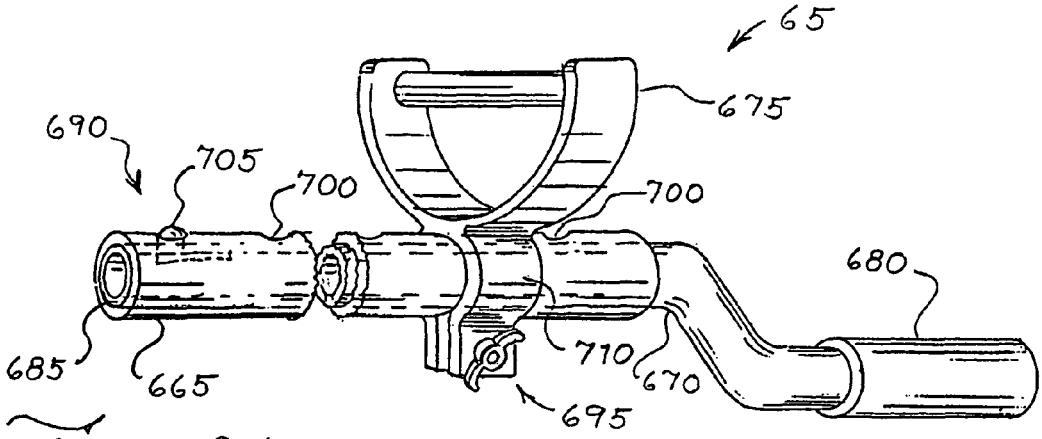
FIG. 21 is a perspective view of an embodiment of the adjustable handle of the extendable scrubber of FIGS. 1 and 3 having a support handle fixator and an extension fixator.
Figure 22:
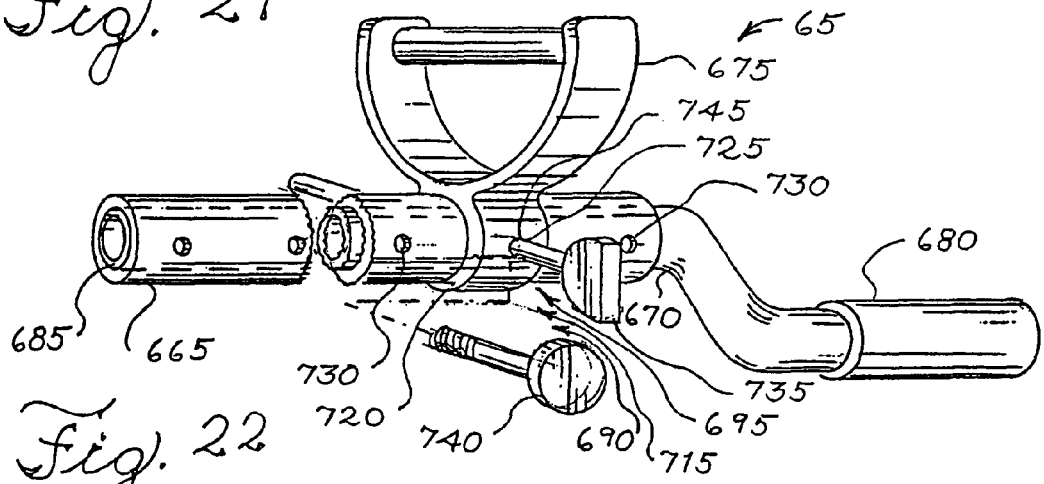
FIG. 22 is a perspective view of an embodiment of the adjustable handle of the extendable scrubber of FIGS. 1 and 3 having a common fixator.
Figure 23:
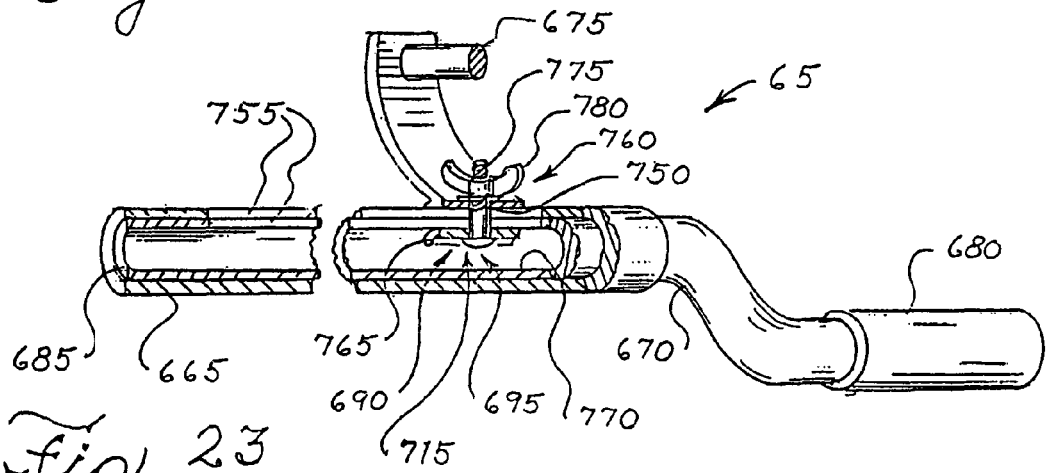
FIG. 23 is a perspective view of another embodiment of the adjustable handle of the extendable scrubber of FIGS. 1 and 3 having a common fixator.

The adjustable connection of the extension 670 with the receiver 665 (as illustrated in the embodiments of FIGS. 21-23) preferably comprises a mating engagement of at least a forward end 685 of the extension with the receiver, and an extension fixator 690 for releasably connecting the extension along the receiver. The adjustable connection of the support handle 675 with the receiver 665 preferably comprises a support handle fixator 695 for releasably connecting the support handle along the receiver. In the embodiment illustrated in FIG. 21, the receiver 665 defines a plurality voids 700 and the extension fixator 690 comprises a snap-pin 705 attached preferably to the forward end 685 of the extension 670 and adapted for selective engagement with the plurality of voids defined in the receiver. Within the same embodiment of FIG. 21, the support handle fixator 695 comprises a clamp 710 defined on the support handle 675 and adapted for engagement about the receiver 665. Although FIG. 21 illustrates the extension fixator 690 as comprising a snap-pin 705, with the support handle fixator 695 comprising a clamp 710, it is understood that other embodiments of each fixator may be utilized as well.

For example, in other embodiments, the extension fixator 690 and the support handle fixator 695 comprise a common fixator 715. In one embodiment utilizing a common fixator 715, illustrated in FIG. 22, the support handle 675 defines a sleeve 720 having a bore 725 there-through, and the receiver 665 and extension 670 each define a plurality through holes 730. The holes 730 defined in the receiver 665 and the extension 670 are adapted for selective alignment with one another and with the bore 725 of the sleeve. The common fixator 715 in the embodiment of FIG. 22 comprises a pin 735 adapted for insertion through the bore 725 of the sleeve 720 and through the aligned holes 730 of the receiver 665 and the extension 670. In a variation of this embodiment illustrated in FIG. 22, a set-screw 740 may be utilized in place of the pin 735 and a threaded bore 745 defined in the sleeve 720 of the support handle 675 in place of the bore 725, with the set-screw adapted for threaded engagement with the threaded bore of the sleeve and further adapted for engagement with the aligned holes 730 of the receiver 665 and the extension 670.

In another embodiment utilizing a common fixator 715 illustrated in FIG. 23, the support handle 675 defines a tensioner bore 750 there-through and the receiver 665 and extension 670 each define an elongated slot 755, with the elongated slots of the receiver and the extension adapted for selective alignment with one another and with the bore of the support handle. The common fixator 715 illustrated in FIG. 23 comprises a tensioner 760, adapted for insertion through the tensioner bore 750 of the support handle 675 and through the elongated slots 755 of the receiver 665 and the extension 670, which is tightened to adjustably connect the support handle and extension along the receiver.

In the embodiment illustrated in FIG. 23, the tensioner 760 preferably comprises a stop 765, adapted for adjustable abutment with an inner surface 770 of the extension 670, and a threaded portion 775 extending there-from and through both the extension and receiver slots 755 and the tensioner bore of the support handle for threaded engagement with a common wing-nut 780. A tightening or loosening of the wing-nut 780 facilitates the adjustable connection of the support and extension handles 775 and 780 with the receiver 665. With such a tightening or loosening of the wing-nut 780, the threaded portion 775 of the tensioner 760, extending through the tensioner bore 750 of the support handle 675 and through the respective selectively-aligned slots 755 of the extension and receiver 670 and 665, respectively brings the stop 765 into abutment with the inner surface 770 of the extension or releases the abutment off the stop therefrom. Regardless of the support handle and extension fixator utilized, the extension 670 is preferably adjustably connected with the receiver 665 through a range of from about 0 inches to about 15 inches along the receiver. The support handle 675 is preferably adjustably connected with the receiver 665 through a range of from about 0 inches to about 17 inches along the receiver.

Figure 24:
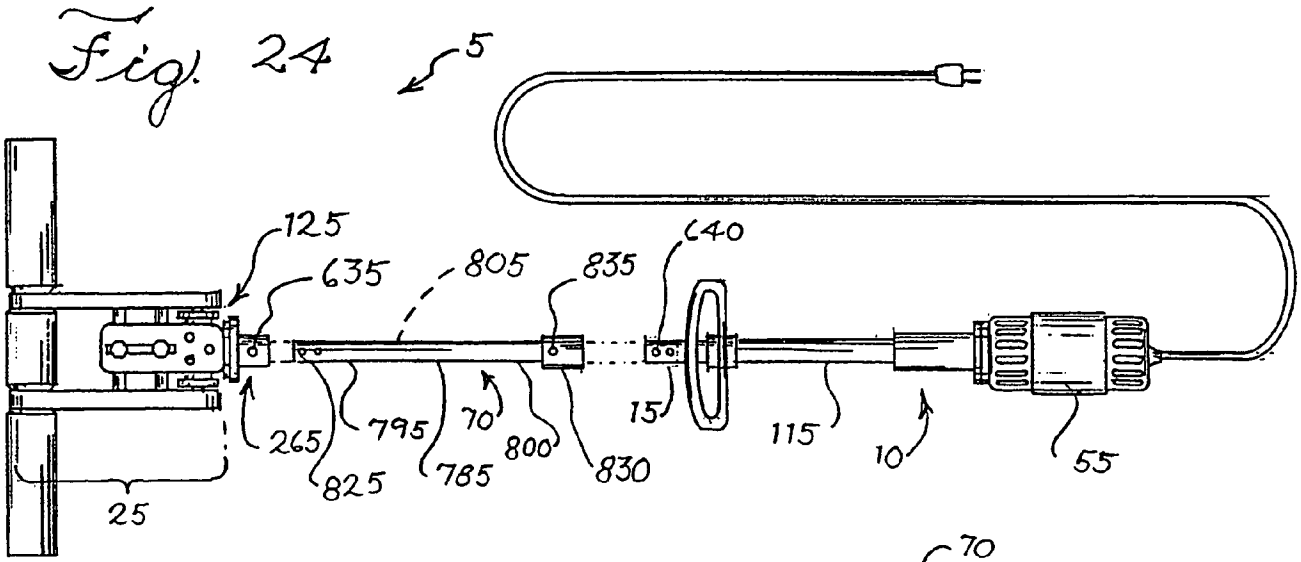
FIG. 24 is a plan view of the extendable scrubber of FIG. 4 illustrating the optional at least one extender located between the scrubber' housing and gearbox.
Figure 25:
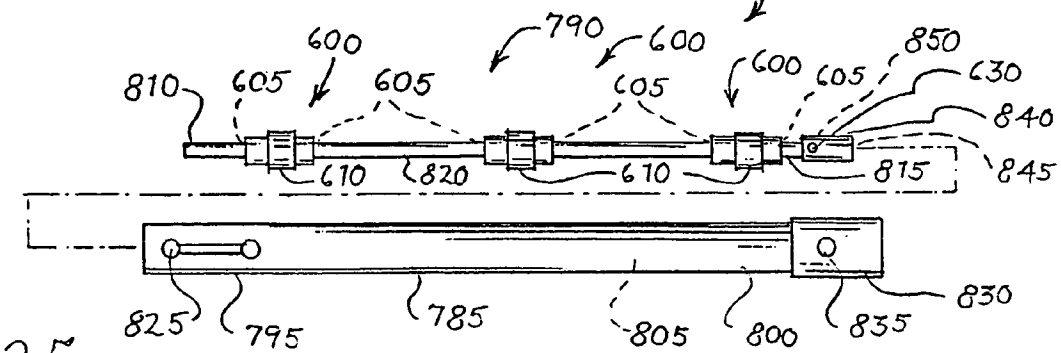
FIG. 25 is a detailed assembly view of the at least one extender of FIG. 24.

Referring to FIGS. 24 and 25 with regard to the embodiment of FIGS. 2 and 4, to facilitate the scrubbing of insulation from areas of extended elevation, the scrubber 5 further comprises at least one extender 70 optionally removably connectable between the housing 10 and gearbox 125 of the framework 25, with the at least one extender operably associating the at least one drive belt 60 with the motor 55 when connected there-between. The at least one extender 70 has forward and rearward ends 795 and 800 and comprises an extender ferrule member 785 enclosing an extender drive link 790. The extender ferrule member has ends defined by the forward and rearward ends 795 and 800 of the extender, and an inner cylindrical surface 805. The extender drive link defines forward and rearward ends 810 and 815 and an outer cylindrical surface 820. The extender ferrule member 785 and extender drive link 790 of the at least one extender 70 preferably have about a common length between their respective forward and rearward ends. In one embodiment, the at least one extender 70, comprising the extender ferrule member 785 enclosing the extender drive link, has a length of from about 12 inches to about 60 inches, more preferably about 24 inches. Thus, given that the extender ferrule member 786 and the extender drive link 790 have about common lengths, the extender ferrule member 785 and extender drive link 790 each have a length of from about 12 inches to about 60 inches, more preferably about 24 inches.

Referring to FIG. 25, to concentrically secure the extender drive link 790 within the extender ferrule member 785 of the extender 70, a plurality of the spacers 600 is located along the extender drive link. Each spacer again preferably comprises a ferrule bushing defining inner and outer cylindrical surfaces 605 and 610. The inner cylindrical surface 605 of each spacer 600 defines a diameter slightly greater than the diameter defined by the outer cylindrical surface 820 of the extender drive link 790 while the outer cylindrical surface 610 of each spacer defines a diameter slightly greater that the inside diameter defined by the inner cylindrical surface 805 of the extender ferrule member 785. The relationship between the respective diameters allows the extender drive link to rotate freely within each spacer while each spacer is secured via a resistance fit within the ferrule member, thus concentrically securing the extender drive link within the extender.

As illustrated in FIGS. 24 and 25, to facilitate the removable connection of at least the forward end of the at least one extender 70 to the gearbox 125 of the framework 25, the forward end 795 of the extender ferrule member 785 is adapted for removable insertion into at least the receiver 265 of the gearbox 125 and includes an extender snap pin 825 for engagement with the transverse bore 635 of the receiver to removably secure the extender to the gearbox. The forward end 810 of the extender drive link 790 is preferably square or hexagon-shaped and thus adapted for removable insertion into at least the like-shaped inlet 620 of the coupling 615 of the gearbox input shaft 560 (FIG. 20).

The rearward end 800 of the at least one extender 70 defines an extender receiver 830 adapted to accept a removable insertion of at least the forward end 15 of the housing ferrule member 115 therein. The extender receiver 830 defines a transverse bore 835 therein adapted for engagement with at least the snap-pin 640 attached to the forward end 15 of the housing ferrule member 115 to removably secure the extender to the housing. The rearward end 815 of the extender drive link 790 preferably has an extender coupling 840 located thereon, with the coupling preferably defining an inlet 845 adapted to accept at least the forward end 585 of the housing drive link 580 (FIG. 20) therein. A threaded bore 850 is defined in the coupling 840 that is adapted to accept a hex screw 630 or similar fastener therein for tightening against the extender link rearward end 815 inserted therein. The forward end 585 of the housing drive link 580 (FIG. 20) and the inlet 845 of the extender coupling 840 receiving it both preferably defines a square or hexagonal shape adapted for mating engagement with one another to rotationally secure at least the housing drive link to the extender link 790 via the coupling while allowing for a ready withdrawal of the drive link from within the coupling.

The forward end 15 of the housing 10 is thus removably connectable with either the gearbox 125 of the framework 25 or the rearward end 800 of the at least one extender 70 while the forward end 585 of the housing drive link 580 is thus removably connectable with either the gearbox input shaft 560 or the rearward end 815 of the extender drive link 790. The forward ends 795 and 810 of the at least one extender 70 and extender drive link 790, in turn, are thus respectively removably connectable with at least the gearbox 125 and gearbox input shaft 560.

Although FIG. 24 illustrates only one extender 70 of the at least one extender utilized between the housing 10 and the gearbox 125 of the framework 25, it is understood that that the at least one extender may comprise any number of extenders, from one extender to a plurality of extenders. Thus, to facilitate the use of a plurality of extenders 70, it is understood that the respective forward ends 795 and 810 of each extender ferrule member 785 and extender drive link 790, in addition to being adapted for removable insertion into the respective gearbox receiver 265 of the framework 25 and gearbox input shaft coupling 615, are also adapted for respective removable insertion into the respective rearward ends 800 and 815 of another extender and extender drive link of the plurality. Thus, the forward ends 795 and 810 each extender 70 and each extender drive link 790 are respectively removably connectable with either the gearbox 125 and gearbox input shaft 560 or the rearward ends 800 and 815 of another extender and extender drive link of the plurality.

It thus follows that the extender receiver 830 and coupling 840 located at the respective rearward ends 800 and 815 of each extender 70 and extender drive link 790, in addition to being adapted to accept the respective removable insertion of the forward ends 15 and 580 of the housing ferrule member and drive link therein, are also adapted to accept the respective removable insertion of the forward ends 795 and 810 of an extender ferrule member and drive link of another extender therein as well. The transverse bore 835 of the extender receiver 830 is adapted for engagement with at least the snap-pin 825 attached to the forward end 795 of the extender ferrule member 785 to removably secure the extenders to one another. The inlet 845 of the extender coupling 840 located at the rearward end 815 of the extender drive link 790 is adapted to accept the forward end 810 of the extender drive link therein (i.e. defines a square or hexagonal shape) to rotationally secure the extender drive links to one another while also allowing for their ready withdrawal from one another.

Thus, wherein the at least one extender 70 comprises a plurality of extenders, each extender is adapted for a removable connection between the housing 10 and the framework 25, between another extender and the framework, between another extender and the housing, or between other extenders of the plurality. Each extender 70 operably associates the at least one drive belt 60 with the motor 55 when connected between the housing 10 and the framework 25, between another extender and the framework, between another extender and the housing, or between other extenders of the plurality. Such an arrangement thus allows for the utilization of any number of extenders 70 in end-to-end relation between the scrubber's housing 10 and gearbox 125 of the framework 25. However, it is understood that no extender 70 may be used between the framework 25 and the housing 10 as well and that the framework and housing may not have a removable connection there-between to facilitate the use of an extender.

Referring again to FIG. 20, an adjustable handle assembly 65 may be connected to the housing 10 of the scrubber 5 of FIGS. 2, 4 and 20, preferably comprising a support handle 675 defining a clamp 710 adapted for adjustable engagement about the ferrule member 115 of the housing, and a grip 855 defined at the rearward end 20 of the housing.

In use, in the scrubber embodiments of FIGS. 1, 3, 18 and 19, the scrubber is grasped by the support handle and extension handle of the adjustable handle assembly. The motor is thereafter energized by turning on the power switch located on the housing of the scrubber. If desired, the RPM and torque selector dials located on the housing of the scrubber are rotated accordingly to control the motor's torque and rotational rate. The motor, operably associated with the drive belts of the at least one drive belt via the pulleys of the at least one pulley, drives the belts which, in turn, are operably associated with the roller assembly.

The drive belts, in some embodiments entrained around the at least forward ends of the arms of the at least one arm, operably engage the grooves defined in the roller assembly and thus drive the roller assembly to rotate. The rotating roller assembly is then brought into contact with the faces of the framing members of a building cavity. The rotating roller assembly is then pulled along the framing members, preferably in a direction about parallel thereto, such that the ribs of the roller assembly contact and scrub the excess or overfill insulation mixture from the cavity and framing members.

To reach areas of extended elevation, the adjustable handle assembly is adjusted to move the extension and support handles further rearward of the roller assembly. In moving the handles, the motor is first preferably de-energized by turning off the power switch located on the scrubber's housing. If using an embodiment with an adjustable handle assembly having separate extension handle and support handle fixators (FIG. 21), the snap-pin located at the forward end of the extension is depressed out of engagement with the respective void. The extension handle is grasped and the handle pulled in a rearward direction along the receiver by a desired distance. Upon reaching a desired location along the receiver rearward of the previous location, the snap-pin is thereafter allowed to engage a desired void located rearward of the previously-engaged void. The clamp of the support handle is loosened from around the receiver and the support handle is thereafter moved in a reawardly direction along the receiver by a desired distance. Upon reaching a desired location along the receiver rearward of the previous location, the clamp of the support handle is again tightened around the receiver.

The scrubber is again grasped by the support handle and extension handle and the motor is again energized through the operation of the power switch located on the scrubber's housing. The rotating roller assembly, now located in an increased forward position from the support and extension handles and thus increasing the reach of the scrubber, is thereafter brought into contact with the faces of the framing members of a building cavity located in an area of extended elevation. The rotating roller assembly is then again pulled along the framing members in the area of extended elevation to contact and scrub the excess or overfill insulation mixture from the cavity and framing members.

If moving the handles further rearward of the roller assembly with embodiments having extension and support handle fixators comprising a common fixator (FIG. 22), the pin is removed from its insertion within the bore of the support handle sleeve and from within the selectively aligned holes of the extension and receiver. If a set-screw is used in place of the pin as the common fixator, the set-screw is removed from threaded engagement with a threaded bore of the support handle sleeve and out of engagement from the selectively aligned holes. The extension handle is again grasped and the handle is pulled in a rearward direction along the receiver by a desired distance. The support handle is also moved in a rearward direction along the receiver by a desired distance. Upon reaching a desired location of the extension and support handles along the receiver rearward of their previous locations, the pin is inserted within the bore of the support handle sleeve and through the selectively aligned holes located rearward of the previous holes. If using a set-screw, the set-screw is threadedly engaged with the threaded bore of the support handle sleeve and into engagement with the selectively aligned holes.

In another embodiment having the extension and support handle fixators comprising a common fixator (FIG. 23), the wing-nut of the tensioner is loosened such that threaded portion of the tensioner, extending through the tensioner bore of the support handle and through the respective selectively-aligned slots of the extension and receiver, releases the stop of the tensioner from abutment with the inner surface of the extension. The extension handle is grasped and the handle is pulled in a rearward direction along the receiver by a desired distance. The support handle is also moved in a rearward direction along the receiver by a desired distance. Upon reaching a desired location of the extension and support handles along the receiver rearward of their previous locations, the wing-nut of the tensioner is again tightened such that threaded portion of the tensioner, extending through the tensioner bore of the support handle and through the respective selectively-aligned slots of the extension and receiver, brings the stop of the tensioner into abutment with the inner surface of the extension. Regardless of the embodiment of the adjustable handle assembly utilized on the scrubber, a reversal of the foregoing operations may be executed to move the extension and support handles in a forward direction to decrease the forward position of the roller assembly in relation to the handles, thus decreasing the reach of the scrubber.

In use in the scrubber embodiment of FIGS. 2, 4, 20 and 24, the scrubber is grasped by the support handle and grip of the handle assembly. The motor is thereafter energized by turning on the power switch located on the motor. If desired, the RPM and torque selector dials located on motor are rotated accordingly to control the motor's torque and rotational rate. The motor, operably associated with the drive belts of the at least one drive belt via the pulleys of the at least one pulley, drives the belts which, in turn, are operably associated with the roller assembly.

The drive belts, in some embodiments entrained around the at least forward ends of the arms of the at least one arm, operably engage the grooves defined in the roller assembly and thus drive the roller assembly to rotate. The rotating roller assembly is then brought into contact with the faces of the framing members of a building cavity. The rotating roller assembly is then pulled along the framing members, preferably in a direction about parallel thereto, such that the ribs of the roller assembly contact and scrub the excess or overfill insulation mixture from the cavity and framing members.

To reach areas of extended elevation, the framework is removed from the forward end of the housing and at least one extender is connected between the housing and framework, with the extender operably associating the at least one drive belt with the motor. In connecting the at least one extender between the housing and the framework, the motor is first preferably de-energized by turning off the power switch located thereon. The snap pin located at the forward end of the housing is depressed and withdrawn from within the receiver of the gearbox to disconnect the housing from the framework. When withdrawing the forward end of the housing from the receiver, the forward end of the housing drive link is also withdrawn from the inlet of the coupling located on the gearbox input shaft.

The forward end of the housing is thereafter inserted into the receiver of the at least one extender, with the snap pin located on the housing's forward end engaging the bore of the receiver to removably secure the housing to the extender. During the engagement of the forward end of the housing into the extender's receiver, the forward end of the housing drive link is inserted into the inlet of the coupling located on the rearward end of the extender drive link. The forward end of the at least one extender is thereafter inserted into the receiver of the gearbox, with the snap pin located on the extender's forward end engaging the bore of the receiver to removably secure the extender to the framework. When inserting the forward end of the at least one extender into the gearbox receiver, the forward end of the extender drive link is inserted into the inlet of the coupling located on the input shaft of the gearbox.

If desired, a plurality of extenders may be utilized in end-to-end relation such that additional extenders are located between the housing and another extender, between the framework and another extender, or between other extenders of the plurality. When connecting one extender to another extender, the forward end of one extender is inserted into the receiver of another extender, with the snap pin located on the one extender's forward end engaging the bore of the receiver of the other extender to removably secure the extenders to one another. During the engagement of the forward end of the one extender into the other extender's receiver, the forward end of the one extenders drive link is inserted into the inlet of the coupling located on the rearward end of the other extender's drive link.

Regardless of extender configuration, the scrubber is again grasped by the support handle and grip and the motor is again energized through the operation of the power switch located thereon. The rotating roller assembly, now located in an increased forward position from the housing and thus increasing the reach of the scrubber, is thereafter brought into contact with the faces of the framing members of a building cavity located in an area of extended elevation. The rotating roller assembly is then again pulled along the framing members in the area of extended elevation to contact and scrub the excess or overfill insulation mixture from the cavity and framing members.

While this foregoing description and accompanying drawings are illustrative, other variations in structure and method are possible without departing from the spirit and scope.

I claim:

1. A scrubber comprising:

a housing;

a framework having first and second ends and defining at least a forward end of at least one arm at the second end, the first end of the framework connected to the housing; a roller assembly comprised of at least one roller, the roller assembly rotatably associated with the at least a forward end of the at least one arm:

a motor connected to the housing and operably associated with at least one drive belt, the at least one drive belt operably associated with the roller assembly; and an adjustable handle assembly connected to the housing for extending the reach of the scrubber, with the adjustable handle assembly comprising a receiver connected to the housing and an extension and a support handle adjustably connected with the receiver, the extension defining an extension handle, and the support handle adjustably connected with the receiver forward of the extension handle when the extension is adjustably connected with the receiver;

with the adjustable connection of the extension with the receiver comprising a mating engagement of at least a forward end of the extension with the receiver and an extension fixator for releasably connecting the extension along the receiver, and wherein the adjustable connection of the support handle with the receiver comprises a support handle fixator for releasably connecting the support handle along the receiver;

with the extension fixator and the support handle fixator comprising a common fixator; and with the support handle defining a tensioner bore therethrough and the receiver and the extension each define an elongated slot, the elongated slots of the receiver and the extension adapted for selective alignment with one another and with the tensioner bore of the support handle, the common fixator comprising a tensioner adapted for insertion through the bore of the support handle and through the elongated slots of the receiver and the extension to adjustably connect the support handle and the extension along the receivers;

the scrubber further comprising a gearbox connected to the housing, the gearbox driving at least one drive pulley and operably associated with the motor, each at least one drive pulley operably engaged with each at least one drive belt to comprise the operable association of the motor with the at least one drive belt.

2. The scrubber of claim 1 wherein the motor drives at least one drive pulley, each at least one drive pulley operably engaging each at least one drive belt to comprise the operable association of the motor with the at least one drive belt.

3. The scrubber of claim 1 wherein the first end of the framework defines at least a rearward end of the at least one arm, the at least a rearward end of the at least one arm connected to the housing.

4. The scrubber of claim 3 wherein the connection of the at least a rearward end of the at least one arm to the housing is adjustable.

5. The scrubber of claim 1 wherein the receiver defines a plurality voids and the extension fixator comprises a snap-pin attached to the forward end of the extension and adapted for selective engagement with the plurality of voids defined in the receiver, and wherein the support handle fixator comprises a clamp defined on the support handle adapted for engagement about the receiver.

6. The scrubber of claim 1 wherein the support handle defines a sleeve having a bore there-through and the receiver and the extension each define a plurality of through holes, the holes defined in the receiver and the extension adapted for selective alignment with one another and with the bore of the sleeve, the common fixator comprising a pin adapted for insertion through the bore of the sleeve and through the aligned holes of the receiver and the extension.

7. The scrubber of claim 1 wherein the support handle defines a sleeve having a threaded bore there-through and the receiver and the extension each define a plurality of through holes, the holes defined in the receiver and the extension adapted for selective alignment with one another and with the threaded bore of the sleeve, the common fixator comprising a set-screw adapted for threaded engagement with the threaded bore of the sleeve and further adapted for engagement with the aligned holes of the receiver and the extension.

8. The scrubber of claim 1 wherein the extension is adjustably connected with the receiver through a range of from about 0 inches to about 15 inches along the receiver and the support handle is adjustably connected with the receiver through a range of from about 0 inches to about 17 inches along the receiver.

9. The scrubber of claim 1 wherein the at least one roller of the roller assembly is comprised of a polyurethane material having a durometer hardness of between about 60 A and about 85 D.

10. The scrubber of claim 1 wherein the at least one roller of the roller assembly is comprised of a polyurethane material having a durometer hardness of about 75 D.

11. The scrubber of claim 1 wherein the at least one roller of the roller assembly defines a plurality of ribs in an outer surface.

12. The scrubber of claim 11 wherein each rib has a triangular cross-section.

13. The scrubber of claim 1 wherein each at least one drive belt is entrained around the at least a forward end of each at least one arm.

14. The scrubber of claim 13 wherein the motor drives at least one drive pulley, each at least one drive pulley operably engaging each at least one drive belt to comprise the operable association of the motor with the at least one drive belt.

15. The scrubber of claim 13 wherein the first end of the framework defines at least a rearward end of the at least one arm, the at least a rearward end of the at least one arm connected to the housing.

16. The scrubber of claim 15 wherein the connection of the at least a rearward end of the at least one arm to the housing is adjustable.

17. The scrubber of claim 13 wherein the adjustable handle assembly comprises a receiver connected to the housing and an extension and a support handle adjustably connected with the receiver, the extension defining an extension handle, and the support handle adjustably connected with the receiver forward of the extension handle when the extension is adjustably connected with the receiver.

18. The scrubber of claim 17 wherein the adjustable connection of the extension with the receiver comprises a mating engagement of at least a forward end of the extension with the receiver and an extension fixator for releasably connecting the extension along the receiver, and wherein the adjustable connection of the support handle with the receiver comprises a support handle fixator for releasably connecting the support handle along the receiver.

19. The scrubber of claim 18 wherein the receiver defines a plurality voids and the extension fixator comprises a snap-pin attached to the forward end of the extension and adapted for selective engagement with the plurality of voids defined in the receiver, and wherein the support handle fixator comprises a clamp defined on the support handle adapted for engagement about the receiver.

20. The scrubber of claim 18 wherein the extension fixator and the support handle fixator comprise a common fixator.

21. The scrubber of claim 20 wherein the support handle defines a sleeve having a bore there-through and the receiver and the extension each define a plurality of through holes, the holes defined in the receiver and the extension adapted for selective alignment with one another and with the bore of the sleeve, the common fixator comprising a pin adapted for insertion through the bore of the sleeve and through the aligned holes of the receiver and the extension.

22. The scrubber of claim 20 wherein the support handle defines a sleeve having a threaded bore there-through and the receiver and the extension each define a plurality of through holes, the holes defined in the receiver and the extension adapted for selective alignment with one another and with the threaded bore of the sleeve, the common fixator comprising a set-screw adapted for threaded engagement with the threaded bore of the sleeve and further adapted for engagement with the aligned holes of the receiver and the extension.

23. The scrubber of claim 17 wherein the extension is adjustably connected with the receiver through a range of from about 0 inches to about 15 inches along the receiver and the support handle is adjustably connected with the receiver through a range of from about 0 inches to about 17 inches along the receiver.

24. The scrubber of claim 13 wherein the at least one roller of the roller assembly is comprised of a polyurethane material having a durometer hardness of between about 60 A and about 85 D.

25. The scrubber of claim 13 wherein the at least one roller of the roller assembly is comprised of a polyurethane material having a durometer hardness of about 75 D.

26. The scrubber of claim 13 wherein the at least one roller of the roller assembly defines a plurality of ribs in an outer surface.

27. The scrubber of claim 26 wherein each rib has a triangular cross-section.

* * * * *